US010062330B2

(12) United States Patent
Han et al.

(10) Patent No.: US 10,062,330 B2
(45) Date of Patent: Aug. 28, 2018

(54) ORGANIC LIGHT EMITTING DISPLAY DEVICE HAVING COMPENSATION PIXEL STRUCTURE

(71) Applicant: LG DISPLAY CO., LTD., Seoul (KR)

(72) Inventors: InHyo Han, Gwangmyeong-si (KR); SangUk Yun, Goyang-si (KR)

(73) Assignee: LG DISPLAY CO., LTD., Seoul (KR)

( * ) Notice: Subject to any disclaimer, the term of this patent is extended or adjusted under 35 U.S.C. 154(b) by 857 days.

(21) Appl. No.: 14/532,492

(22) Filed: Nov. 4, 2014

(65) Prior Publication Data

US 2015/0170569 A1 Jun. 18, 2015

(30) Foreign Application Priority Data

Dec. 13, 2013 (KR) ..... 10-2013-0155542

(51) Int. Cl.

*G09G 3/3258* (2016.01)
*G09G 3/3233* (2016.01)
*G09G 3/3266* (2016.01)

(52) U.S. Cl.

CPC ..... *G09G 3/3258* (2013.01); *G09G 3/3233* (2013.01); *G09G 3/3266* (2013.01); *G09G 2300/0819* (2013.01); *G09G 2300/0852* (2013.01); *G09G 2300/0866* (2013.01); *G09G 2300/0876* (2013.01); *G09G 2320/0204* (2013.01); *G09G 2320/0219* (2013.01)

(58) Field of Classification Search

CPC ... G09G 2320/0219; G09G 2320/0204; G09G 2300/0819; G09G 2320/0876; G09G 2320/0852; G09G 2320/0866; G09G 3/3266; G09G 3/3258; G09G 3/3233

See application file for complete search history.

(56) References Cited

U.S. PATENT DOCUMENTS

| | | | | |
|---|---|---|---|---|
| 2005/0057182 | A1 | 3/2005 | Shibusawa | |
| 2009/0284519 | A1 | 11/2009 | Kim et al. | |
| 2010/0289830 | A1 | 11/2010 | Yamamoto et al. | |
| 2011/0164071 | A1 | 7/2011 | Chung et al. | |
| 2013/0249857 | A1* | 9/2013 | Kimura | H01L 27/0629 345/174 |
| 2014/0022288 | A1* | 1/2014 | Tsuge | G09G 3/3233 345/690 |

FOREIGN PATENT DOCUMENTS

| | | | |
|---|---|---|---|
| CN | 101286298 | A | 10/2008 |
| CN | 101847363 | A | 9/2010 |
| KR | 20050109167 | A | 11/2005 |
| KR | 10-2011-0032251 | A | 3/2011 |
| KR | 101113430 | B1 | 3/2012 |
| KR | 20130010936 | A | 1/2013 |
| WO | 2005/122120 | A2 | 12/2005 |
| WO | 2013021623 | A1 | 2/2013 |

* cited by examiner

*Primary Examiner* — Mark Edwards
(74) *Attorney, Agent, or Firm* — Dentons US LLP

(57) ABSTRACT

An organic light-emitting display device having a pixel structure able to significantly improve threshold voltage compensation capability and range by compensating for a loss in a threshold voltage that would occur during operation.

14 Claims, 30 Drawing Sheets

100

63GRAY

255GRAY

63GRAY

63GRAY

255GRAY

ORGANIC LIGHT EMITTING DISPLAY DEVICE HAVING COMPENSATION PIXEL STRUCTURE

CROSS REFERENCE TO RELATED APPLICATION

This application claims priority from and the benefit under 35 U.S.C. § 119(a) of Korean Patent Application Number 10-2013-0155542 filed on Dec. 13, 2013, which is hereby incorporated by reference for all purposes as if fully set forth herein.

BACKGROUND OF THE INVENTION

Field of the Invention

The present invention relates to an organic light-emitting display device.

Description of Related Art

Organic light-emitting display devices that are recently in the spotlight as next generation display devices have advantages, such as relatively fast response speeds, high light emitting efficiency and luminance and wide viewing angles, since they use organic light-emitting diodes (OLEDs) that emit light by themselves.

Organic light-emitting display devices have a matrix structure in which pixels including organic light-emitting diodes are arranged, in which the brightness of each pixel selected by a scanning signal is controlled according to the grayscale of data.

Each pixel in such an organic light-emitting display device includes an organic light-emitting diode (OLED) as well as a driving transistor for driving the OLED. The driving transistor has unique characteristics such as a threshold voltage and mobility. A difference in the characteristic value between the driving transistors of adjacent pixels may reduce the luminance quality of the corresponding pixels.

Therefore, the development of pixel structures for compensating for the threshold voltage and mobility of the driving transistor is underway.

However, in spite of such compensation technology, information about the threshold voltage is lost by a parasitic capacitor component at the gate node of the driving transistor, which is problematic. The loss in the information about the threshold voltage may lead to a severe non-uniform image quality.

BRIEF SUMMARY OF THE INVENTION

Various aspects of the present invention provide an organic light-emitting display device having a pixel structure able to significantly improve threshold voltage compensation capability and range by compensating for a loss in a threshold voltage that would occur during operation.

Also provided is an organic light-emitting display device having a pixel structure able to compensate for mobility and control a mobility compensation time based on a capacitor design within the pixel structure, thereby achieving a sufficient data writing time.

Also provided is an organic light-emitting display device having a pixel structure that has superior global uniformity characteristics.

In an aspect of the present invention, provided is an organic light-emitting display device that includes: a display panel on which data lines and gate lines are disposed to define a number of pixels; a data driver driving the data lines; a gate driver driving the gate lines; and a timing controller controlling the data driver and the gate driver. Each of the pixels includes: an organic light-emitting diode; a driving transistor driving the organic light-emitting diode, wherein the driving transistor includes a first node forming a gate node, a second node connected to the organic light-emitting diode and a third node connected to a driving voltage line; a first transistor controlled by a first scanning signal, the first transistor being connected between a source voltage line and the first node of the driving transistor; a first storage capacitor connected between the first node and the second node of the driving transistor; a second storage capacitor and a boost capacitor between the first node and the second node of the driving transistor; a second transistor controlled by a second scanning signal, the second transistor being connected between a hold node to which the second storage capacitor and the boost capacitor are connected and a corresponding data line of the data lines; and a third transistor controlled by a third scanning signal, the third transistor being connected between the first node of the driving transistor and the hold node.

In another aspect of the present invention, provided is an organic light-emitting display device that includes: a display panel on which data lines and gate lines are disposed to define a number of pixels; a data driver driving the data lines; a gate driver driving the gate lines; and a timing controller controlling the data driver and the gate driver. Each of the pixels includes: an organic light-emitting diode; a driving transistor driving the organic light-emitting diode, wherein the driving transistor includes a first node forming a gate node, a second node connected to the organic light-emitting diode and a third node connected to a driving voltage line; a first transistor controlled by a first scanning signal, the first transistor being connected between a source voltage line and the first node of the driving transistor; a first storage capacitor connected between the first node and the second node of the driving transistor; a second storage capacitor and a boost capacitor between the first node and the second node of the driving transistor; a second transistor controlled by a second scanning signal, the second transistor being connected between a hold node to which the second storage capacitor and the boost capacitor are connected and a corresponding data line of the data lines; a third transistor controlled by a third scanning signal, the third transistor being connected between the first node of the driving transistor and the hold node; and a fourth transistor connected between the second node of the driving transistor and an initialization voltage line, the fourth transistor being controlled by the third scanning signal by which the third transistor is controlled.

In a further aspect of the present invention, provided is an organic light-emitting display device that includes: a display panel on which data lines and gate lines are disposed to define a number of pixels; a data driver driving the data lines; a gate driver driving the gate lines; and a timing controller controlling the data driver and the gate driver. Each of the number of pixels includes: an organic light-emitting diode; a driving transistor driving the organic light-emitting diode, wherein the driving transistor includes a first node forming a gate node, a second node connected to the organic light-emitting diode and a third node connected to a driving voltage line; a first transistor controlled by a first scanning signal, the first transistor being connected between a source voltage line and the first node of the driving transistor; a first storage capacitor connected between the first node and the second node of the driving transistor; a second storage capacitor and a boost capacitor between the first node and the second node of the driving transistor; and a second transistor controlled by a second scanning signal, the second transistor being connected between a hold node to which the second storage capacitor and the boost capacitor are connected and a corresponding data line of the data lines.

In a further another aspect of the present invention, provided is an organic light-emitting display device that includes: a display panel on which data lines and gate lines are disposed to define a number of pixels; a data driver driving the data lines; a gate driver driving the gate lines; and a timing controller controlling the data driver and the gate driver. Each of the number of pixels includes: an organic light-emitting diode; a driving transistor driving the organic light-emitting diode, wherein the driving transistor includes a first node forming a gate node, a second node connected to the organic light-emitting diode and a third node connected to a driving voltage line; a first transistor controlled by a first scanning signal, the first transistor being connected between a source voltage line and the first node of the driving transistor; a first storage capacitor connected between the first node and the second node of the driving transistor; a second storage capacitor and a boost capacitor between the first node and the second node of the driving transistor; a second transistor controlled by a second scanning signal, the second transistor being connected between a hold node to which the second storage capacitor and the boost capacitor are connected and a corresponding data line of the data lines; and a third transistor connected between the second node of the driving transistor and an initialization voltage line, the third transistor being controlled by the second scanning signal by which the second transistor is controlled.

According to the present invention as set forth above, the organic light-emitting display device has the pixel structure able to significantly improve threshold voltage compensation capability and range by compensating for a loss in a threshold voltage that would occur during operation.

In addition, the organic light-emitting display device has the pixel structure able to compensate for mobility and control a mobility compensation time based on a capacitor design within the pixel structure, thereby achieving a sufficient data writing time.

Furthermore, the organic light-emitting display device has the pixel structure having superior global uniformity characteristics.

BRIEF DESCRIPTION OF THE DRAWINGS

The above and other objects, features and advantages of the present invention will be more clearly understood from the following detailed description when taken in conjunction with the accompanying drawings, in which.

DETAILED DESCRIPTION OF THE INVENTION

Figure 1:
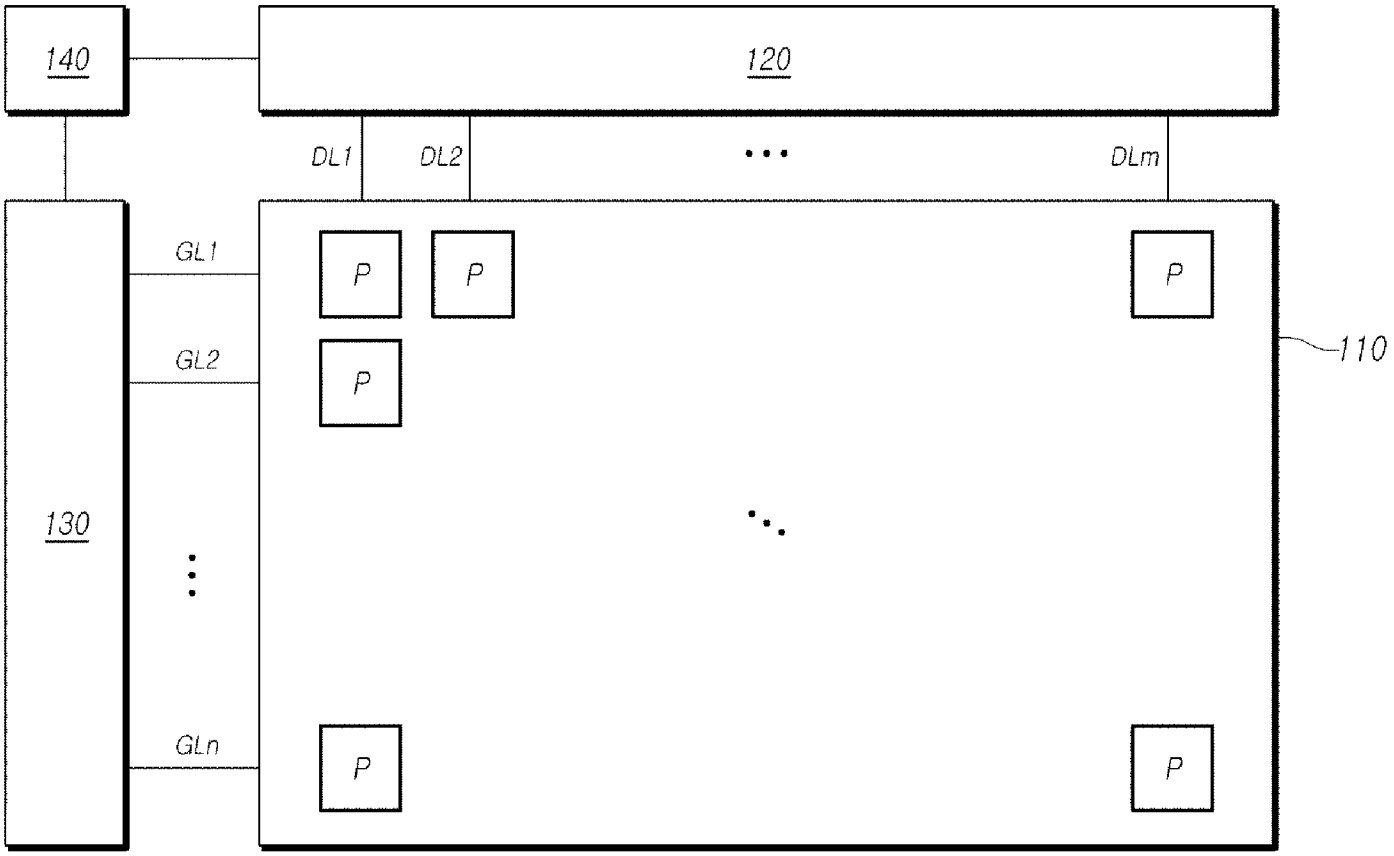
FIG. 1 is a schematic system configuration view illustrating an organic light-emitting display device according to exemplary embodiments of the present invention.

Reference will now be made in detail to the present invention, embodiments of which are illustrated in the accompanying drawings. Throughout this document, reference should be made to the drawings, in which the same reference numerals and signs may be used throughout the different drawings to designate the same or similar components. In the following description of the present invention, detailed descriptions of known functions and components incorporated herein will be omitted in the case that the subject matter of the present invention may be rendered unclear thereby.

It will also be understood that, although terms such as "first," "second," "A," "B," "(a)" and "(b)" may be used herein to describe various elements, such terms are only used to distinguish one element from another element. The substance, sequence, order or number of these elements is not limited by these terms. It will be understood that when an element is referred to as being "connected to" or "coupled to" another element, not only can it be "directly connected" or "coupled to" the other element, but also can it be "indirectly connected or coupled to" the other element via an "intervening" element. In the same context, it will be understood that when an element is referred to as being formed "on" or "under" another element, not only can it be directly formed on or under another element, but also can it be indirectly formed on or under another element via an intervening element.

FIG. 1 is a schematic system configuration view illustrating an organic light-emitting display device 100 according to exemplary embodiments of the present invention.

Referring to FIG. 1, the organic light-emitting display device 100 includes a display panel 110 on which a plurality of data lines DL1 to DLm and a plurality of gate lines GL1 to GLn are disposed such that a number of pixels P are defined, a data driver 120 for driving the data lines LD1 to DLm, a gate driver 130 for driving the gate lines GL1 to GLn, and a timing controller 140 for controlling the data driver 120 and the gate driver 130.

The data driver 120 may include a plurality of data driver integrated circuits (also referred to as source driver integrated circuits) that may be connected to the bonding pads of the display panel 110 by a tape automated bonding (TAB) method or a chip-on-glass (COG) method, may be directly formed on the display panel 110 by a gate-in-panel (GIP) method, or may be integrated on the display panel 110.

The gate driver 130 may be positioned only at one side of the display panel 110 as illustrated in FIG. 1 or may be divided into two sections each of which is positioned on either side of the display panel 110.

The gate driver 130 can provide each of the pixels with one or more scanning signals according to several pixel structures, which will be described later.

In addition, the gate driver 130 may include a plurality of gate driver integrated circuits that may be connected to the bonding pads of the display panel by a tape automated bonding (TAB) method or a chip-on-glass (COG) method, may be directly formed on the display panel 110 by a gate-in-panel (GIP) method, or may integrated on the display panel 110.

The timing controller 140 controls the operation timing of the data driver 120 and the gate driver 130, and outputs a variety of control signals for this purpose.

Each of the pixels of the organic light-emitting display device 100 includes an organic light-emitting diode (OLED) and a circuit for driving the OLED.

The circuit for driving the OLED includes a driving transistor for supplying a current to the OLED, a switching transistor for applying a data voltage to a gate node of the driving transistor, and a storage capacitor for maintaining a data voltage for the period of one frame. The circuit can further include at least one transistor for compensating for the threshold voltage Vth and the mobility of the driving transistor.

The pixel structures may vary according to the numbers and the connecting structures of the transistors and the capacitors included in the circuit.

Reference will be made to five pixel structures according to five exemplary embodiments of the present invention.

First, a pixel structure including four transistors and one capacitor according to a first exemplary embodiment will be described with reference to FIG. 2 to FIG. 4.

Figure 2:
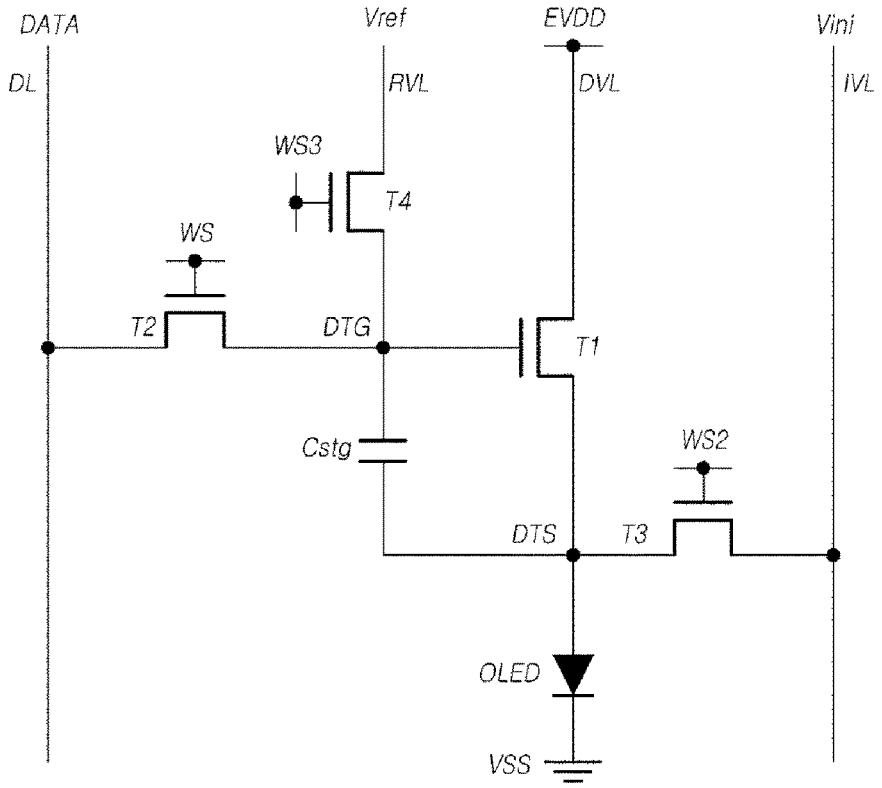
FIG. 2 is an equivalent circuit diagram illustrating a pixel structure of an organic light-emitting display device according to a first exemplary embodiment of the present invention.

FIG. 2 is an equivalent circuit diagram illustrating the pixel structure of an organic light-emitting display device 100 according to the first exemplary embodiment.

Referring to FIG. 2, each pixel of the organic light-emitting display device 100 according to the first embodiment has a pixel structure including an organic light-emitting diode (OLED), a first transistor T1 connected between a driving voltage line DVL through which a driving voltage EVDD is supplied and the OLED, a second transistor T2 connected between a data line DL and a gate node DTG of the first transistor T1, a third transistor T3 connected between a source node DTS of the first transistor T1 and an initialization voltage line IVL through which an initialization voltage Vini is supplied, a fourth transistor T4 connected between a reference voltage line through which a reference voltage Vref is supplied and the gate node DTG of the first transistor T1, and a storage capacitor Cstg connected between the gate node DTG and the source node DTS of the first transistor T1.

The first transistor T1 is a driving transistor for driving the OLED.

Although the four transistors T1 to T4 are illustrated as being an N type, this is merely an illustrative example, and the four transistors may be designed to be a P type.

A description will be given of an operation method of each pixel having this pixel structure with reference to an operation timing diagram illustrated in FIG. 3.

Figure 3:
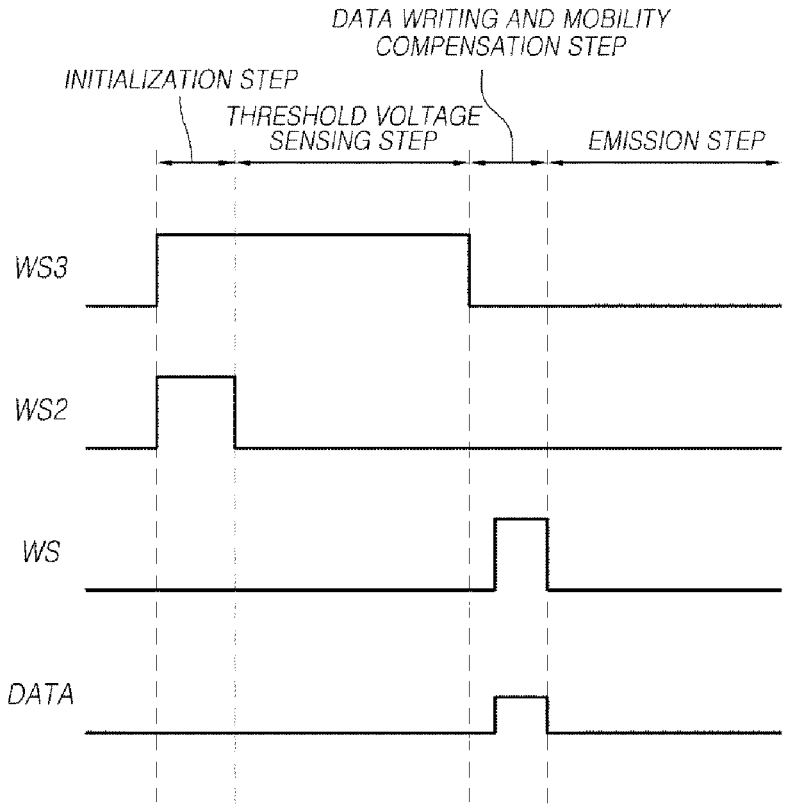
FIG. 3 is an operation timing diagram of a pixel having the pixel structure of the organic light-emitting display device according to the first exemplary embodiment.

FIG. 3 is the operation timing diagram of a pixel having the pixel structure of the organic light-emitting display device according to the first exemplary embodiment.

Referring to FIG. 3, the pixel having the pixel structure of the organic light-emitting display device 100 according to the first embodiment carries out an operation, including an initialization step, a threshold voltage sensing step, a data writing and mobility compensation step and an emission step.

Referring to FIG. 3, at the initialization step, the second transistor T2 is turned off, and the fourth transistor T4 and the third transistor T3 are turned on, such that the gate node DTG and the source node DTS of the first transistor T1 are respectively initialized with a reference voltage Vref and an initialization voltage Vini.

Referring to FIG. 3, at the threshold voltage sensing step, the third transistor T3 is turned off, and the source node DTS of the first transistor T1 senses a threshold voltage of the first transistor T1. That is, the voltage Vs at the source node DTS of the first transistor T1 can be expressed including the threshold voltage (Vs=Vref−Vth).

At this time, information about the threshold voltage Vth of the first transistor T1 is stored in the storage capacitor Cstg. That is, the difference in the voltage between both ends of the storage capacitor Cstg is identical to the threshold voltage Vth of the first transistor T1.

Referring to FIG. 3, at the data writing and mobility compensation step, the third transistor T3 and the fourth transistor T4 are turned off, and the second transistor T2 is turned on, such that a data voltage Vdata is applied to (or written in) the gate node DTG of the first transistor T1.

At this time, the first transistor T1 is turned on, and the voltage at the source node DTS of the first transistor T1 increases.

The increase in the voltage at the source node DTS of the first transistor T1 is proportional to the mobility of the first transistor T1.

For example, assuming that the mobility of the first transistor T1 is $\mu 1$ or $\mu 2$, where $\mu 1 > \mu 2$, a voltage change $\Delta DTS1$ at the source node DTS when the mobility of the first transistor T1 is $\mu 1$ is greater than a voltage change $\Delta DTS2$ at the source node DTS when the mobility of the first transistor T1 is $\mu 2$. Accordingly, the voltage difference Vgs1 between the gate node DTG and the source node DTS when the mobility of the first transistor T1 is $\mu 1$ is smaller than the voltage difference Vgs2 between the gate node DTG and the source node DTS at the mobility of the first transistor T1 is $\mu 2$.

Based on the degree in a voltage increase (or voltage change) at the source node DTS of the first transistor T1, the mobility of the first transistor T1 can be sensed, and variations in the mobility can be compensated by negative feedback.

Referring to FIG. 3, at the emission step, all of the transistors T2 to T4 except for the first transistor T1 serving as the driving transistor are turned off The OLED starts emitting light while the voltage at the source node DTS of the first transistor T1 increases such that the current of the first transistor T1 is identical to that of the OLED.

At this time, information about the threshold voltage that has been present at the source node DTS of the first transistor T1 is transferred to the gate node DTG of the first transistor T1, thereby compensating for the threshold voltage of the first transistor T1.

Specifically, the voltage at the source node DTS of the first transistor T1 is expressed without the threshold voltage, and the voltage of the gate node DTG of the first transistor T1 is expressed including the threshold voltage. The first transistor T1 can drive the OLED free from the influence of the threshold voltage.

The pixel structure of the organic light-emitting display device 100 according to the first embodiment makes possible the threshold voltage sensing, the mobility compensation and the like that have been problematic in the related art.

As described above, in the pixel structure of the organic light-emitting display device 100 according to the first embodiment, at the threshold voltage sensing step, the threshold voltage Vth of the first transistor T1 serving as the driving transistor is stored in the source node DTS of the first transistor T1. The threshold voltage Vth stored in the source node DTS of the first transistor T1 in this fashion is transferred to the gate node DTG of the first transistor T1 serving as the driving transistor at the emission step.

Here, storing the threshold voltage in the source node DTS of the first transistor T1 indicates that the voltage at the source node DTS of the first transistor T1 can be expressed by the threshold voltage. In addition, the transfer of the threshold voltage Vth stored in the source node DTS of the first transistor T1 to the gate node DTG of the first transistor T1 indicates that the threshold voltage included in a voltage formula of the source node DTS of the first transistor T1 is included in a voltage formula of the gate node DTG of the first transistor T1.

Figure 4:
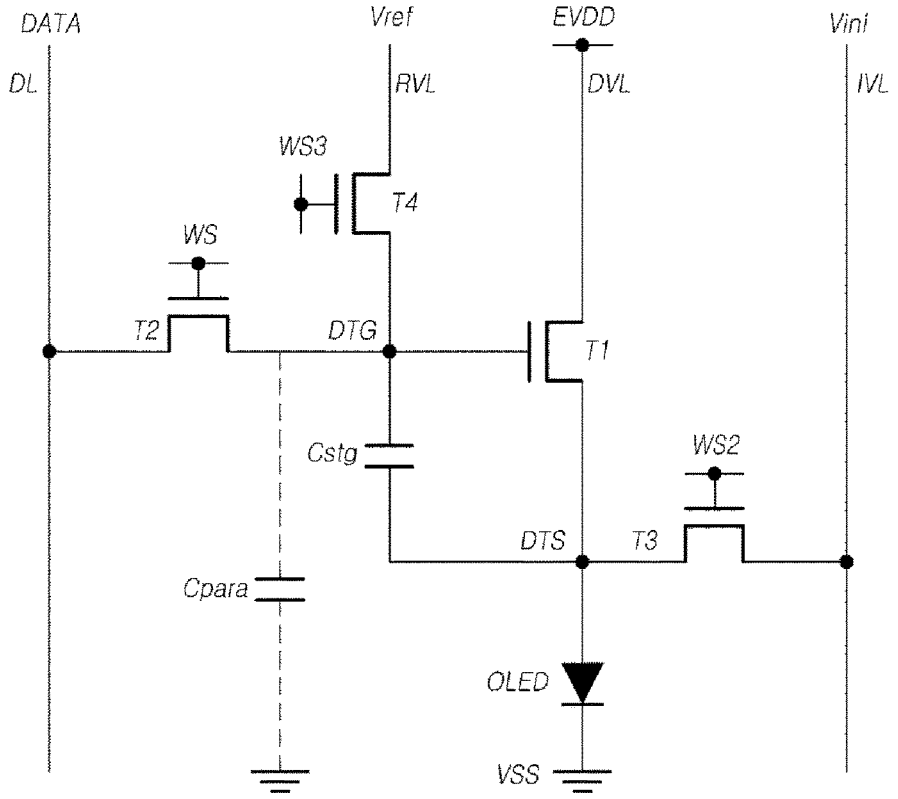
FIG. 4 is a circuit diagram illustrating a parasitic capacitor component of the pixel structure of the organic light-emitting display device according to the first exemplary embodiment.

In the process of storing and transferring the threshold voltage, as illustrated in FIG. 4, a parasitic capacitor Cpara formed at the gate node DTG of the first transistor T1 serving as the driving transistor may cause a loss in the threshold voltage.

In particular, the loss in the threshold voltage caused by the parasitic capacitor Cpara formed at the gate node DTG of the first transistor T1 may create a relatively-large gate source voltage at a low grayscale that is controlled based on a small gate source voltage of the driving transistor T1, thereby leading to a severe non-uniform image quality at the threshold voltage.

In addition, the compensation range for the threshold voltage may be significantly reduced, thereby lowering the yield of transistors.

Furthermore, it is difficult to obtain a sufficient data writing time due to a short mobility compensation time.

Therefore, reference will now be made to exemplary embodiments (second to fifth embodiments) of the pixel structure that can significantly improve threshold voltage compensation capability and range by compensating for a loss in a threshold voltage that would occur during operation, can compensate for mobility and control a mobility compensation time based on a capacitor design within the pixel structure, thereby achieving a sufficient data writing time, and has superior global uniformity characteristics.

First, a description will be given of a 4T3C pixel structure including four transistors (T) and three capacitors (C) according to a second exemplary embodiment with reference to FIG. 5 to FIG. 16.

Figure 5:
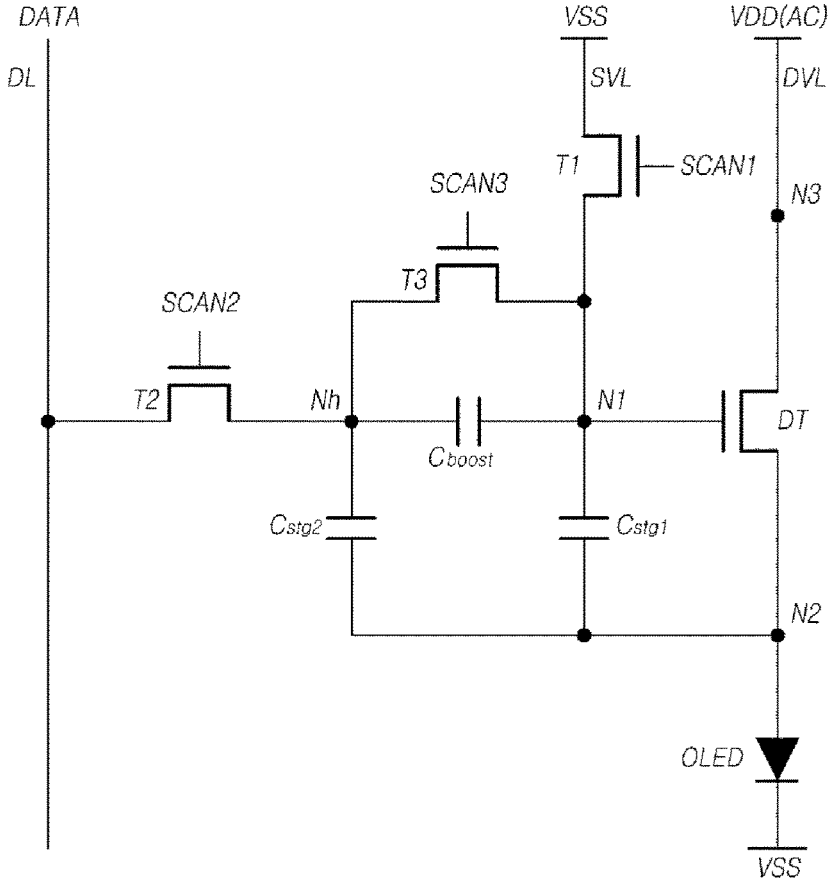
FIG. 5 is an equivalent circuit diagram illustrating a pixel structure of an organic light-emitting display device according to a second exemplary embodiment of the present invention.

FIG. 5 is an equivalent circuit diagram illustrating the pixel structure of the organic light-emitting display device 100 according to the second exemplary embodiment of the present invention.

Referring to FIG. 5, each of pixels defined on the display plane 110 of the organic light-emitting display device 100 according to the second embodiment includes: an organic light-emitting diode (OLED); four transistors including a driving transistor DT, a first transistor T1, a second transistor T2 and a third transistor T3; and three capacitors including a first storage capacitor Cstg1, a second storage capacitors Cstg2 and a boost capacitor Cboost.

The driving transistor DT drives the OLED, and includes a first node N1 forming a gate node, a second node N2 connected to the OLED and a third node N3 connected to a driving voltage line DVL through which a driving voltage EVDD is supplied.

The first transistor T1 is controlled by a first scanning signal SCAN1, and is connected between a source voltage line SVL and the first node N1 of the driving transistor DT.

The first storage capacitor Cstg1 is connected between the first node N1 and the second node N2 of the driving transistor DT.

The second storage capacitor Cstg2 and the boost capacitor Cboost are connected between the first node N1 and the second node N2 of the driving transistor DT.

The second transistor T2 is controlled by a second scanning signal SCAN2, and is connected between a hold node Nh to which the second storage capacitor Cstg2 and the booster capacitor Cboost are connected and a data line DL.

The third transistor T3 is controlled by a third scanning signal SCAN3, and is connected between the first node N1 of the driving transistor DT and the hold node Nh.

In the pixel structure of the organic light-emitting display device 100 according to the second embodiment, a driving voltage VDD applied to the third node N3 of the driving transistor DT through the driving voltage line DVL is an AC voltage, which is shifted by 1 H.

Here, the driving voltage VDD at a low level can be indicated by VDD(−), and the driving voltage VDD at a high level can be indicated by VDD(+).

In the pixel structure of the organic light-emitting display device 100 according to the second embodiment, the three capacitors have their own capacitances. Comparing the capacitances of the first storage capacitor Cstg, the boost capacitor Cboost and the second storage capacitor Cstg2, the capacitance of the second storage capacitor Cstg2 is designed smallest. The capacitances of the first storage capacitor Cstg1 and the boost capacitor Cboost are designed similar to each other.

A description will be given below of the operation of the pixel having the above-described 4T3C pixel structure.

Figure 6:
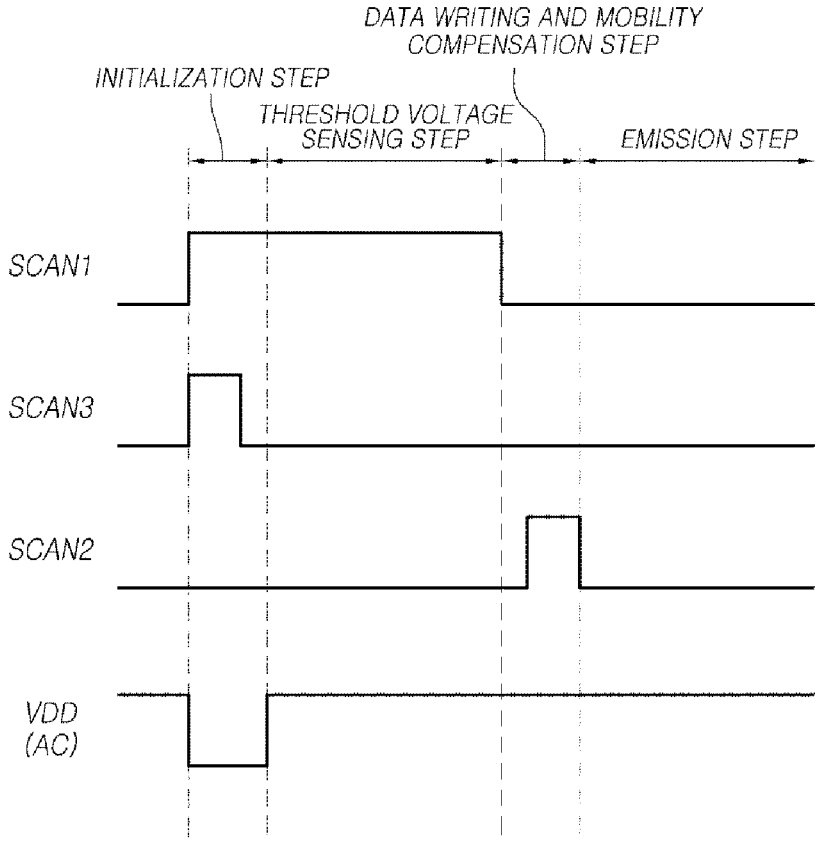
FIG. 6 is an operation timing diagram of a pixel having the pixel structure of the organic light-emitting display device according to the second exemplary embodiment.

FIG. 6 is an operation timing diagram of a pixel having the pixel structure of the organic light-emitting display device 100 according to the second exemplary embodiment.

Referring to FIG. 6, the pixel having the pixel structure of the organic light-emitting display device 100 according to the second embodiment carries out an operation, including an initialization step, a threshold voltage sensing step, a data writing and mobility compensation step and an emission step.

A description will be given below of the respective steps of the operation with reference to FIG. 7A, FIG. 7B, FIG. 8A, FIG. 8B, FIG. 9, FIG. 10A, FIG. 10B, FIG. 11, FIG. 12A and FIG. 12B.

Figure 7A:
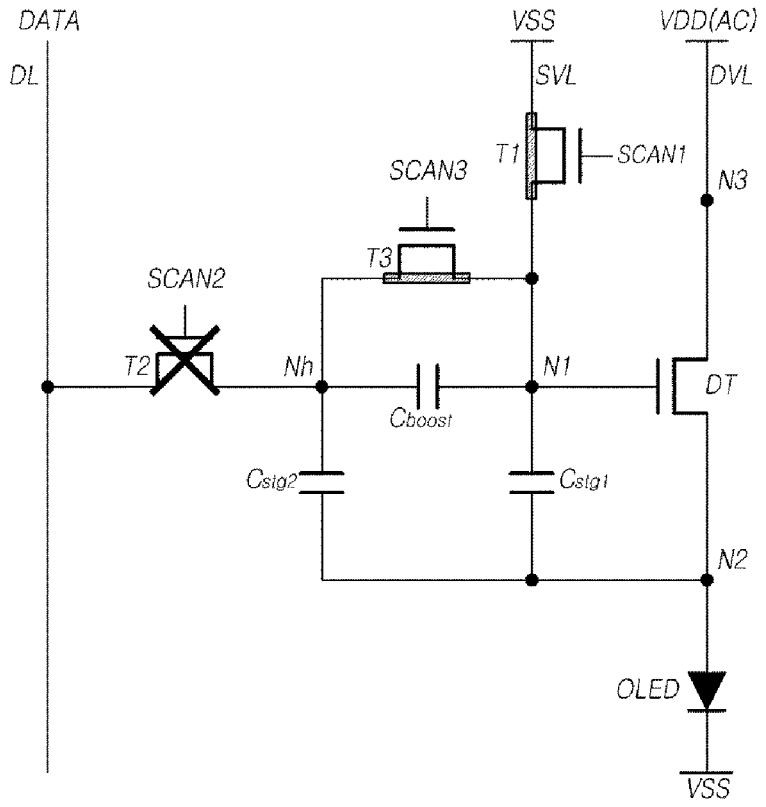
FIG. 7A, FIG. 7B, FIG. 8A, FIG. 8B, FIG. 9, FIG. 10A, FIG. 10B, FIG. 11, FIG. 12A and FIG. 12B are circuit diagrams illustrating the operation according to process steps and graphs illustrating voltage changes at major nodes in the pixel structure of the organic light-emitting display device according to the second exemplary embodiment.
Figure 7B:
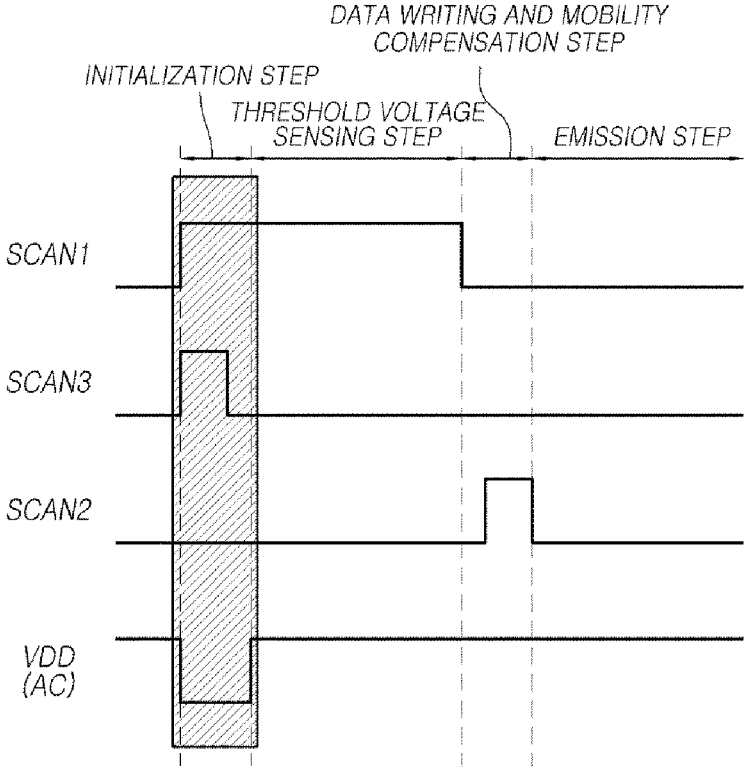

First, referring to FIG. 7A and FIG. 7B, at the initialization step, a low level driving voltage VDD(−) is applied to the third node N3 of the driving transistor DT, the first transistor T1 and the third transistor T3 are turned on by a first scanning signal SCAN1 and a second scanning signal SCAN2 that are high level scanning signals, and the second transistor T2 is turned on by a second scanning signal SCAN2 that is a low level scanning signal.

Accordingly, the hold node Nh and the first node N1 of the driving transistor DT are initialized using a source voltage Vss, and the second node N2 of the driving transistor DT is initialized using the low level driving voltage VDD(−).

At this initialization step, voltages at the first node N1 of the driving transistor DT, the second node N2 of the driving transistor DT and the hold node Nh can be expressed as in following Formula 1:

Voltage of EN1=VSS

Voltage of EN1=VSDD(−)

Voltage of ENh=VSS Formula 1

In Formula 1, VSS indicates a source voltage, and VSDD (−) indicates a low level driving voltage.

Figure 8A:
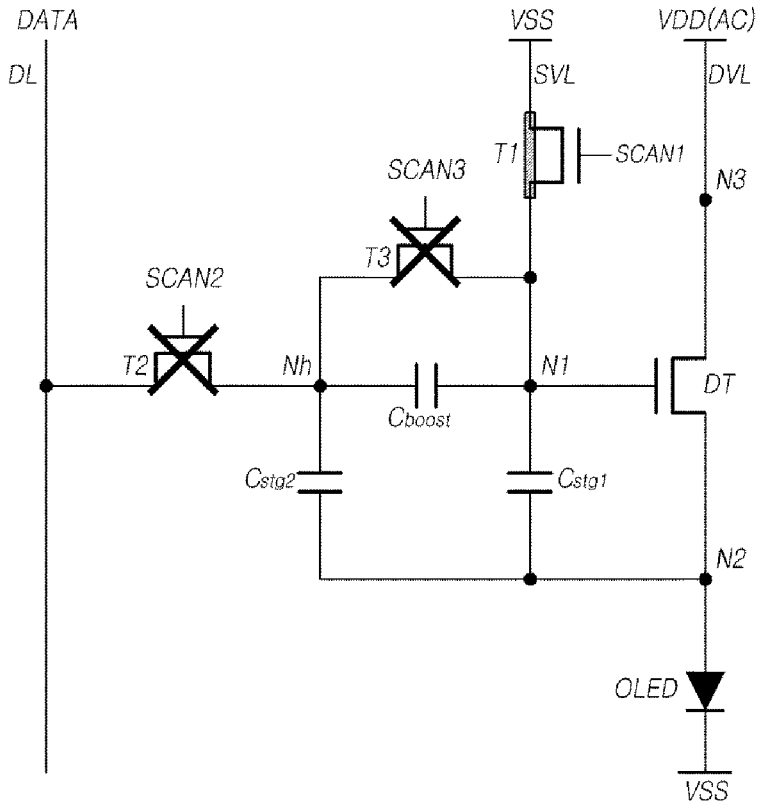
Figure 8B:
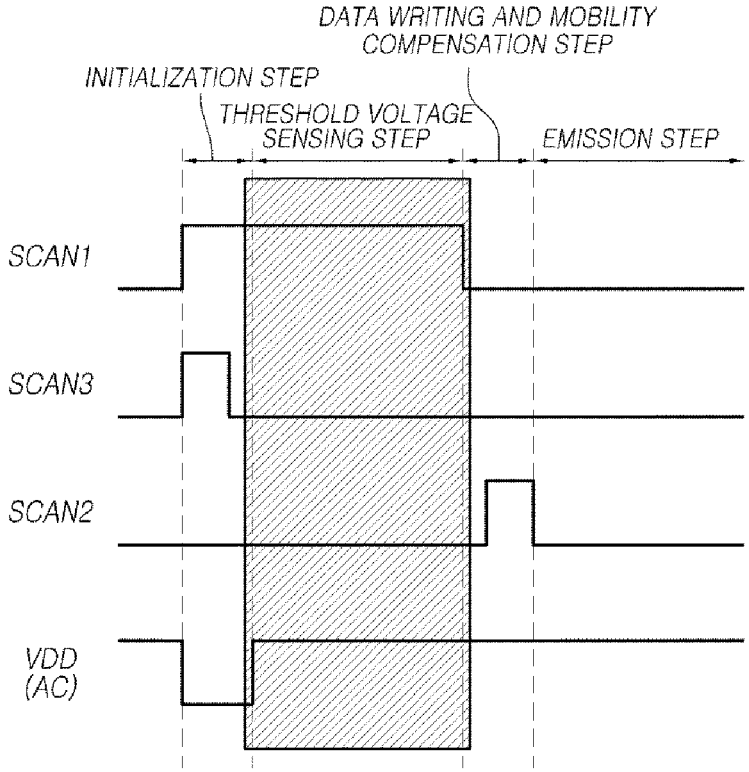

Afterwards, referring to FIG. 8A and FIG. 8B, at the threshold voltage sensing step, a high level driving voltage VDD(+) is applied to the third node N3 of the driving transistor DT, the first transistor T1 is maintained at the turned-on state by a high level first scanning signal SCAN1, the second transistor T2 is turned off by a low level second voltage signal SCAN2, and the third transistor T3 is turned off by a low level third scanning signal SCAN3.

At this threshold voltage sensing step, changes in voltages at the first node N1 of the driving transistor DT, the second node N2 of the driving transistor DT and the hold node Nh will be discussed with reference to FIG. 9.

Figure 9:
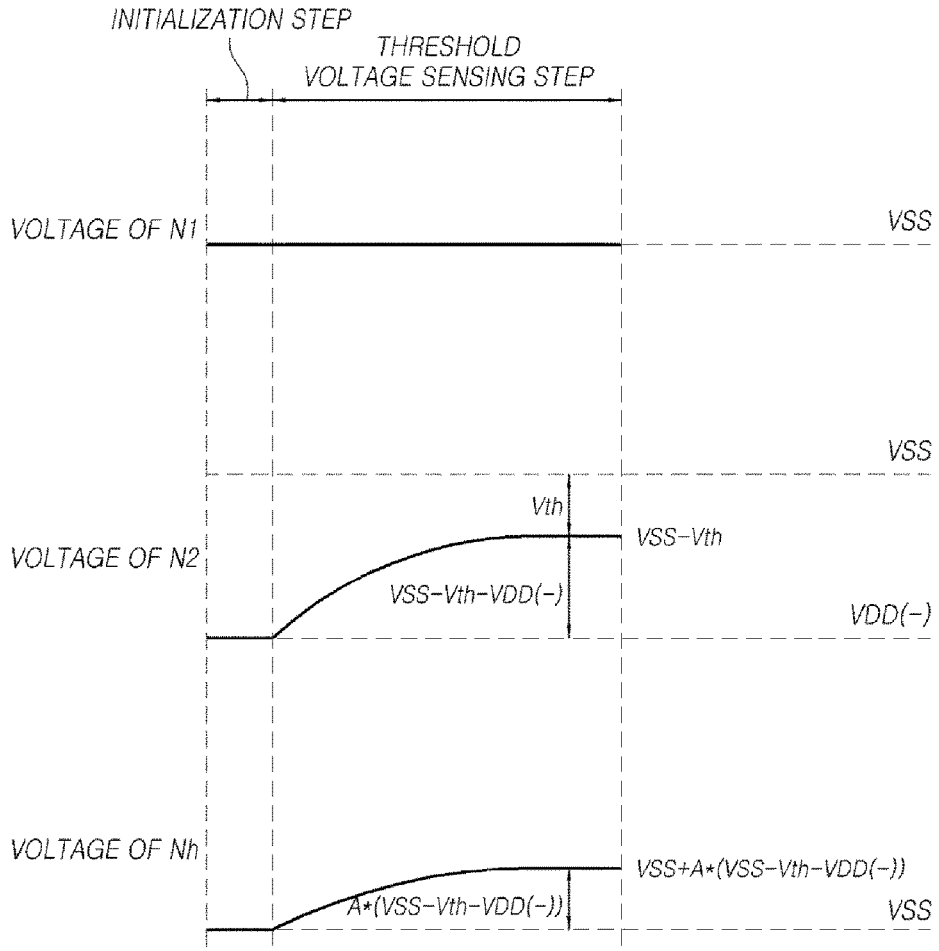

Referring to FIG. 9, at the threshold voltage sensing step, the first node N1 of the driving transistor DT is maintained at the source voltage VSS.

In addition, at the threshold voltage sensing step, the voltage at the second node N2 of the driving transistor DT increases from the initialized voltage VDD(−). The voltage increases from VDD(−) to VSS−Vth, which is less than the source voltage Vss, i.e. the voltage at the first node N1 of the driving transistor DT, by the threshold voltage Vth.

Therefore, at the threshold voltage sensing step, a voltage change at the second node N2 of the driving transistor DT is VSS−Vth−VDD(−).

In addition, at the threshold voltage sensing step, the voltage at the hold node Nh increases according to the voltage change VSS−Vth−VDD(−) at the second node N2 of the driving transistor DT and a first capacitance ratio A.

More specifically, the voltage at the hold node Nh increases by a value obtained by multiplying the voltage change VSS−Vth−VDD(−) at the second node N2 of the driving transistor DT with the first capacitance ratio A. Here, the first capacitance ratio A is a value obtained by dividing the capacitance of the second storage capacitor Cstg2 with a total of the capacitance of the boost capacitor Cboost and the capacitance of the second storage capacitor Cstg2.

At the threshold voltage sensing step, the voltages at the first node N1 of the driving transistor DT, the second node N2 of the driving transistor DT and the hold node Nh can be expressed by following Formula 2 and Formula 3:

Voltage of EN1=VSS

Voltage of $EN2=VSS-Vth$

Voltage of $EN2=VSS+A*(VSS-Vth-VDD(-))$, where $A=Cstg2/(Cboost+Cstg2)$ Formula 2

If VSS=0,

Voltage of EN1=0

Voltage of EN2=−Vth

Voltage of $EN2=-A*(VDD(-)+Vth)$ Formula 3

In Formula 2 and Formula 3, VSS indicates a source voltage, Vth indicates a threshold voltage of the driving transistor DT, VDD(−) indicates a low level driving voltage, A indicates a first capacitance ratio, Cstg2 indicates a capacitance of the second storage capacitor Cstg2, and Cboost indicates a capacitance of the boost capacitor Cboost.

Figure 10A:
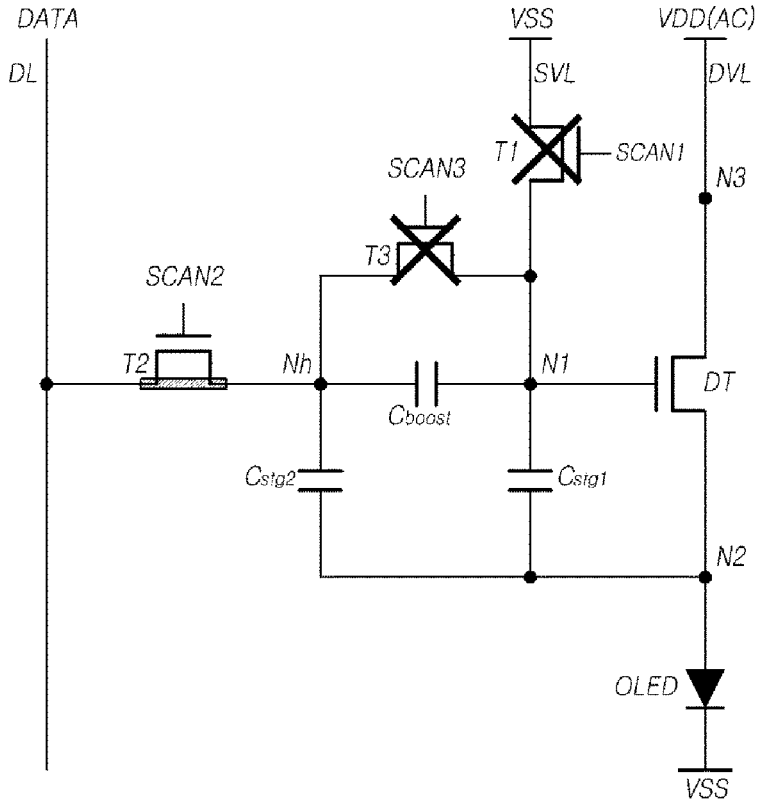
Figure 10B:
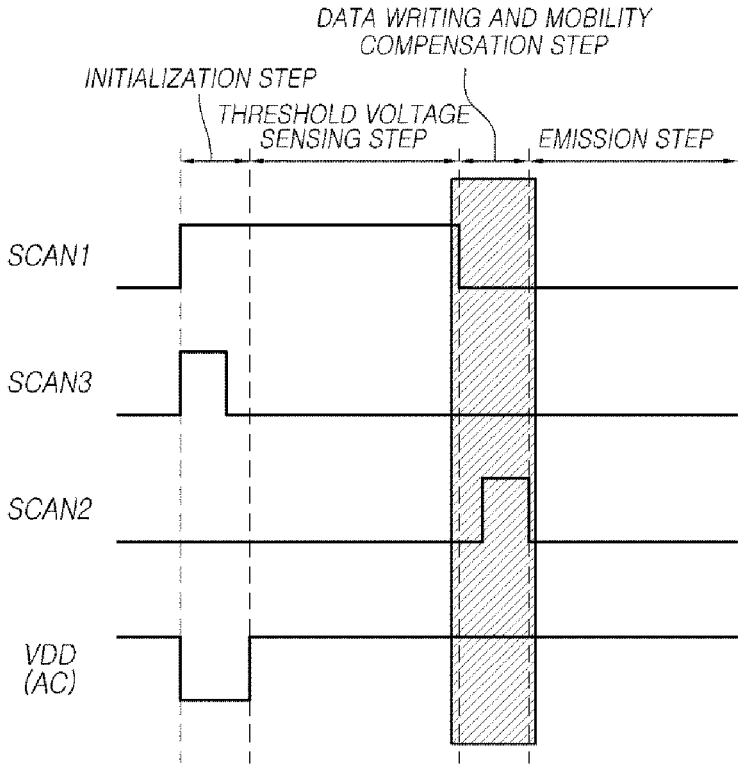

Afterwards, referring to FIG. 10A and FIG. 10B, at the data writing and mobility sensing step, the second transistor T2 is turned on by a high level second scanning signal SCAN2, a data voltage Vdata is applied through the data line DL to the turn on second transistor T2, a high level driving voltage VDD(+) is applied to the third node N3 of the driving transistor DT, and the first transistor T1 is turned on by a low level first scanning signal SCAN1.

At the data writing and mobility sensing step, the second transistor T2 is turned on, by which the data voltage Vdata supplied through the data line DL is applied to the hold node Nh.

Consequently, the voltage at the hold node Nh increases to the data voltage Vdata.

A voltage change at the hold node Nh is expressed by Vdata−[VSS+A*(VSS−Vth−VDD(−))].

In response to the mobility sensing, the voltage at the second node N2 of the driving transistor DT increases further from the voltage VSS−Vth that has increased at the threshold voltage sensing step.

A voltage change ΔVu at the second node N2 of the driving transistor DT due to this voltage increase may vary according to a voltage change ΔVp at the hold node Nh.

In response to a coupled data being applied to the first node N1 of the driving transistor DT and, simultaneously, the mobility sensing, the voltage at the first node N1 of the driving transistor DT increases from the source voltage VSS that has been maintained through the threshold voltage sensing step.

The voltage at the first node N1 of the driving transistor DT can increase according to the voltage change ΔVp at the hold node Nh, the voltage change ΔVu at the second node N2 of the driving transistor DT in response to the mobility sensing operation, a second capacitance ratio B and a third capacitance ratio C.

More specifically, the voltage at the first node N1 of the driving transistor DT increases further by a voltage value B*ΔVp+C*ΔVu, i.e. a total of a voltage obtained by multiplying the voltage change ΔVp at the hold node Nh with the second capacitance ratio B and a voltage obtained by multiplying the voltage change ΔVu at the second node N2 of the driving transistor DT in response to the mobility sensing operation with the third capacitance ratio C.

Here, the second capacitance ratio B is a value obtained by dividing the capacitance of the boost capacitor Cboost with a total of the capacitance of the first storage capacitor Cstg1 and the capacitance of the boost capacitor Cboost.

The third capacitance ratio C is a value obtained by the capacitance of the first storage capacitor Cstg1 with a total of the capacitance of the boost capacitor Cboost and the capacitance of the first storage capacitor Cstg1.

This third capacitance ratio C can determine the rate at which the difference in the voltage between the first node N1 and the second node N2 of the driving transistor DT decreases.

At the data writing and mobility sensing step, voltages at the first node N1 of the driving transistor DT, the second node N2 of the driving transistor DT and the hold node Nh can be expressed by following Formula 4 and Formula 5 (VSS=0):

$$\text{Voltage of } EN1 = VSS + B^*\Delta Vp + C^*\Delta Vu$$

$$\text{Voltage of } EN2 = VSS - Vth + \Delta Vu$$

$$\text{Voltage of } ENh = V\text{data} - Vss + A^*(VSS - Vth - VDD(-)) + \Delta Vp$$

$$\text{where } B = C\text{boost}/(Cstg1 + C\text{boost})$$

$$C = Cstg1/(C\text{boost} + Cstg1) \qquad \text{Formula 4}$$

If VSS=0, $$\text{Voltage of } EN1 = B^*\Delta Vp + C^*\Delta Vu$$

$$\text{Voltage of } EN2 = -Vth + \Delta Vu$$

$$\text{Voltage of } ENh = V\text{data} = -A^*(VDD(-) + Vth) + \Delta Vp \qquad \text{Formula 5}$$

In Formula 4 and Formula 5, VSS indicates a source voltage, Vth indicates a threshold voltage of the driving transistor DT, VDD(−) indicates a low level driving voltage, Vdata indicates a data voltage, ΔVp indicates a voltage change at the hold node Nh, ΔVu indicates a voltage change at the second node N2 of the driving transistor DT, B indicates a second capacitance, C indicates a third capacitance, Cstg1 indicates a capacitance of the first storage capacitor Cstg1, and Cboost indicates a capacitance of the boost capacitor.

Figure 12A:
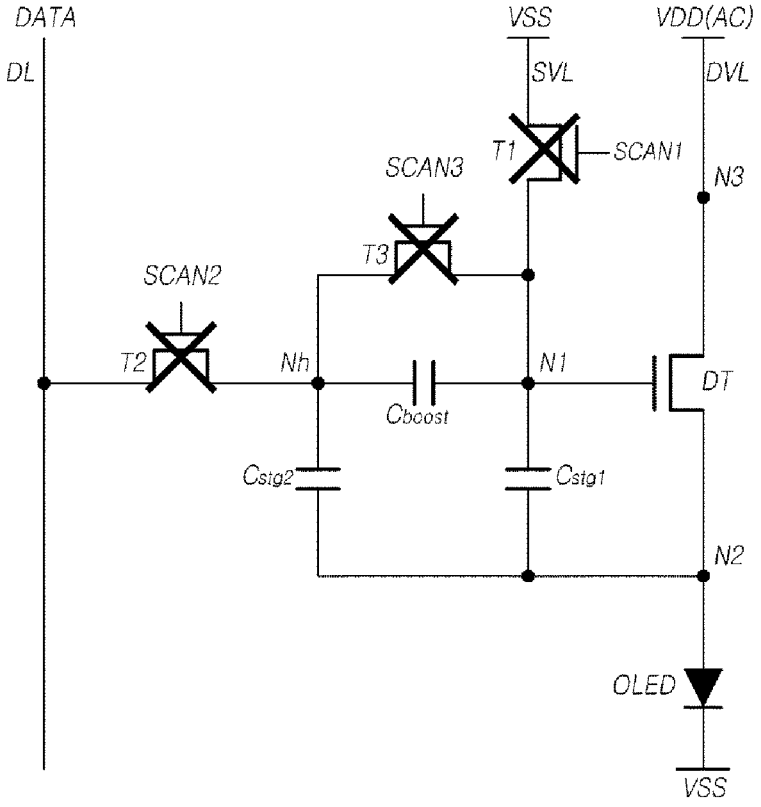
Figure 12B:
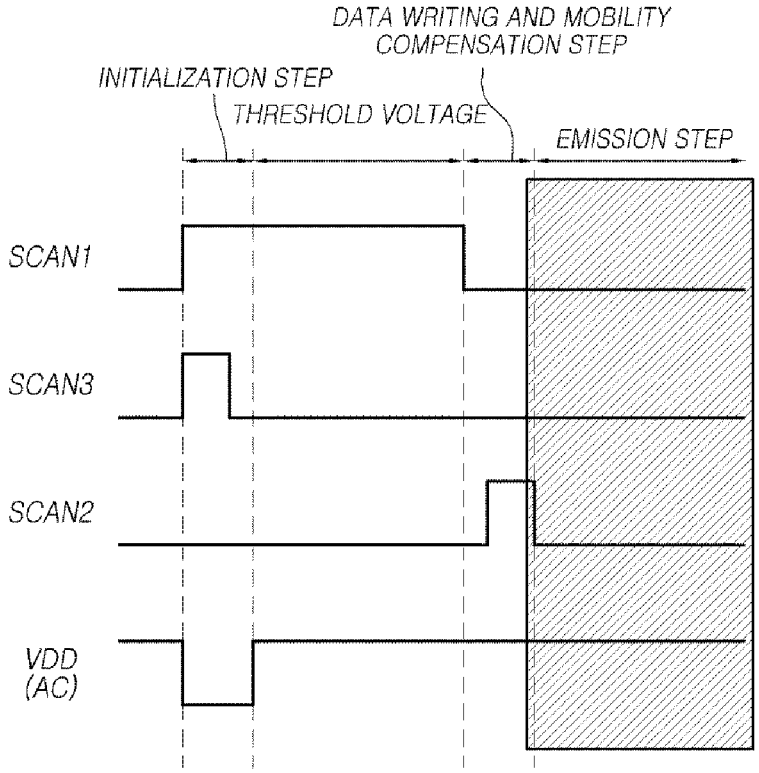

In sequence, referring to FIG. 12A and FIG. 12B, at the emission step, all of the driving transistor DT, the first transistor T1, the second transistor T3 are turned off Consequently, the voltage at the second node N2 of the driving transistor DT increases, and the OLED emits light.

At this time, a threshold voltage of the driving voltage DT is transferred.

A current Ids flowing between the drain node N3 and the source node N2 of the driving transistor DT can be expressed by following Formula 6:

$$Ids = k(Vgs - Vth)^2, \qquad \text{Formula 6}$$

$$\text{where } k = \frac{1}{2}\mu Cox\frac{W}{L}$$

In Formula 6, Ids indicates a current flowing between the drain node N3 and the source node N1 of the driving transistor DT, Vgs indicates a difference in the voltage between the first node N1 and the second node N2 of the driving transistor DT, and Vth is a threshold voltage of the driving transistor DT. k is a component about the mobility of the driving transistor DT, and is defined by mobility μ, an oxide capacitance Cox, a channel width W and a channel length L.

When the OLED emits light, the current flowing between the drain node N3 and the source node N2 of the driving transistor DT is identical to a current Ioled flowing through the OLED.

Therefore, it is possible to determine whether or not the threshold voltage Vth of the driving transistor DT has an effect on a corresponding pixel, i.e. whether or not the threshold voltage Vth of the driving transistor DT has an effect on the current Ioled flowing through the OLED, by evaluating "Vgs−Vth."

Based on the voltages at the first node N1 of the driving transistor DT, the second node N2 of the driving transistor DT and the hold node Nh according to the above-described steps, Vgs−Vth can be expressed by following Formula 7:

$$\begin{aligned} Vgs - Vth &= Bs\Delta Vp + Cs\Delta Vu - (-Vth + \Delta Vu) - Vth \\ &= B(\text{Data} + A(VDD(-) + Vth)) + Cs\Delta Vu + Vth - \Delta Vu - Vth \\ &= BsData + BsAsVDD(-) + BsAsVth - \Delta Vus(1 - C), \end{aligned} \qquad \text{Formula 7}$$

$$\text{where } A = Cstg2/(Cboost + Ctg2)$$

$$B = (Cboost/Cstg1 + Cboost)$$

$$C = Cstg1/(Cboost + Cstg1)$$

In Formula 7, VSS indicates a source voltage, Vth indicates a threshold voltage of the driving transistor DT, VDD(−) indicates a low level driving voltage, Vdata indicates a data voltage, ΔVp indicates a voltage change at the hold node Nh, ΔVu indicates a voltage change at the second node N2 of the driving transistor DT, A indicates a first capacitance ratio, B indicates a second capacitance ratio, C indicates a third capacitance ratio, Cstg1 indicates a capacitance of the first storage capacitor Cstg1, Cboost indicates a capacitance of the boost capacitor Cboost, and Cstg2 indicates a capacitance of the second storage capacitor Cstg2.

In Formula 7, "B*A*Vth" is a part that cancels a loss in the threshold voltage. If the capacitances of the three capacitors Cstg1, Cstg2 and Cboost are determined such that B*A is very small, B*A*Vth in Vgs−Vth becomes a negligibly small value. It is possible to make a current flow through the OLED without a significant effect on the threshold voltage Vth of the driving transistor DT.

Considering this, it is possible to control the part that cancels the loss through the second storage capacitor Cstg2.

Specifically, the capacitance of the capacitor Cstg2 makes it possible to determine the amount to control at compensation for the loss in the information about the threshold voltage caused by the parasitic capacitor Cpara of the first node N1 of the driving transistor DT.

In addition, in Formula 7, ΔVu*(1−C) indicates a decrease in the voltage difference Vgs between the first node N1 and the second node N2 of the driving transistor DT at the mobility sensing step.

Here, the third capacitance ratio C can reduce the rate at which the voltage difference Vgs decreases. Specifically, the third capacitance ratio C determines the reduction rate of the voltage difference Vgs between the first node N1 and the second node N2 of the driving transistor DT.

FIG. 13A, FIG. 13B, FIG. 14A, FIG. 14B, FIG. 15A, FIG. 15B and FIG. 16 are graphs illustrating a variety of simulations on the pixel structure of the organic light-emitting display device 100 according to the second exemplary embodiment.

Figure 13A:
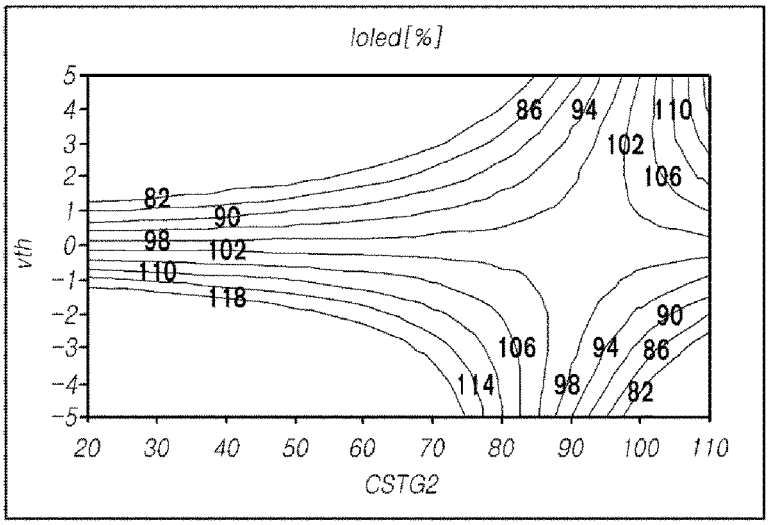
FIG. 13A, FIG. 13B, FIG. 14A, FIG. 14B, FIG. 15A, FIG. 15B and FIG. 16 are graphs illustrating a variety of simulations on the pixel structure of the organic light-emitting display device according to the second exemplary embodiment.
Figure 13B:
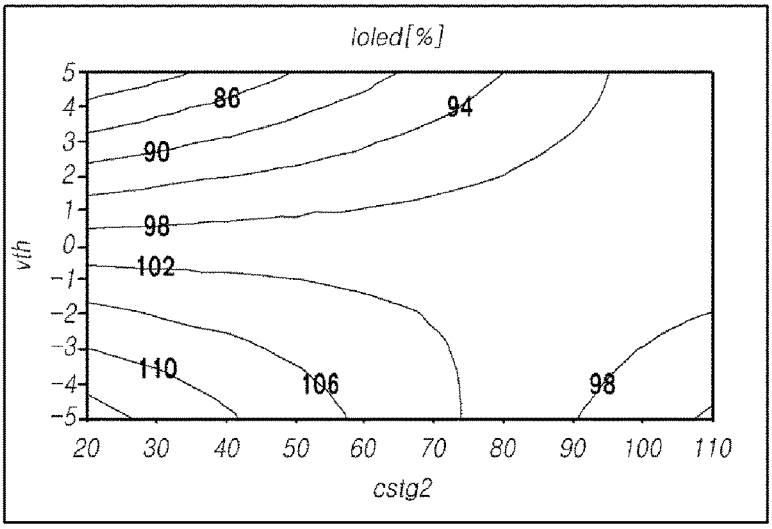

FIG. 13A and FIG. 13B illustrate the results of simulations on the threshold voltage compensation capability of the pixel structure according to the second embodiment, performed by changing the second capacitor Cstg2 in order to compensate for a loss in the threshold voltage caused by the parasitic capacitor Cpara.

Referring to FIG. 13A and FIG. 13B, the pixel structure has the capacitance value of the second capacitor Cstg2 that has optimum performance at both a low gray level (63 Gray) and a high gray level (255 Gray).

Figure 14A:
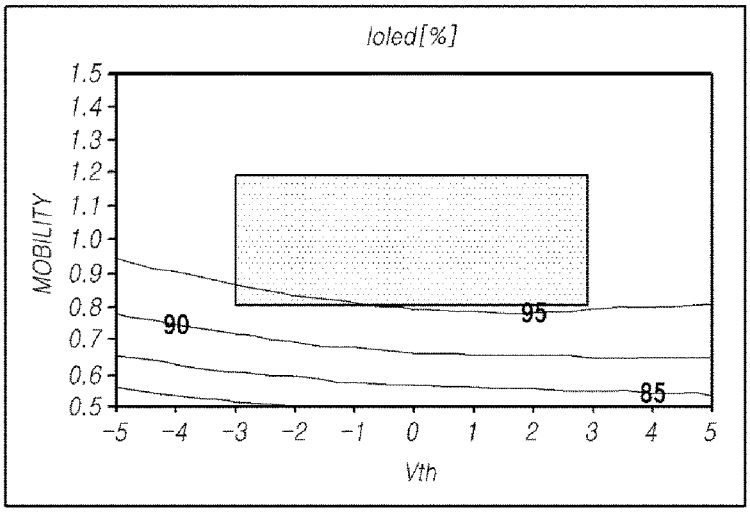
Figure 14B:
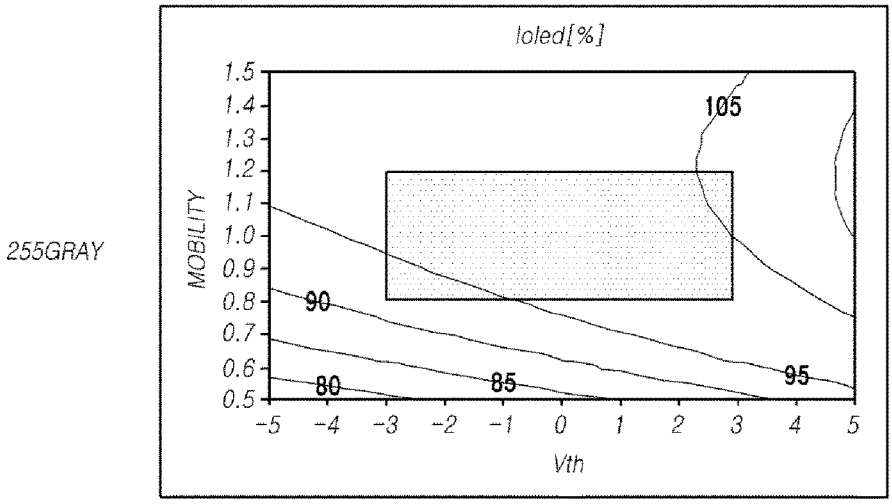

FIG. 14A and FIG. 14B illustrate the results of simulations on the complex compensation capability of the pixel structure according to the second embodiment when both the threshold voltage Vth and the mobility of the driving transistor DT deviate from a reference.

Referring to FIG. 14A and FIG. 14B, it is appreciated that there are wide compensation ranges for the threshold voltage Vth and the mobility at either a low gray level (63 Gray) or a high gray level (255 Gray) when ΔIoled is within 5%.

Figure 15A:
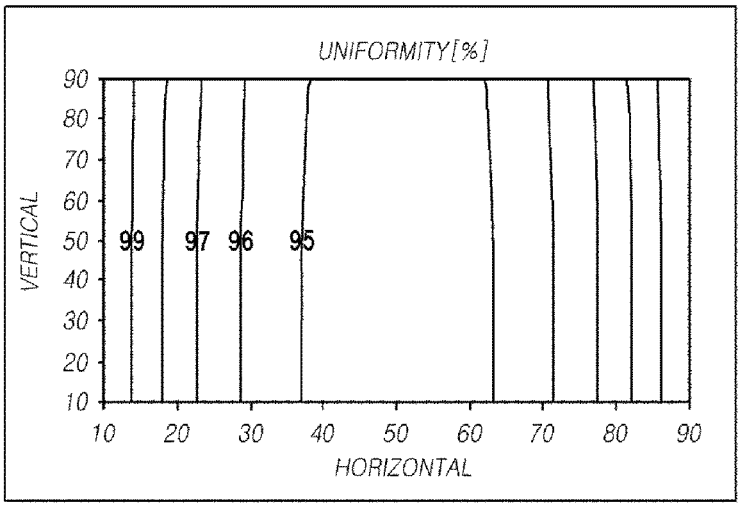
Figure 15B:
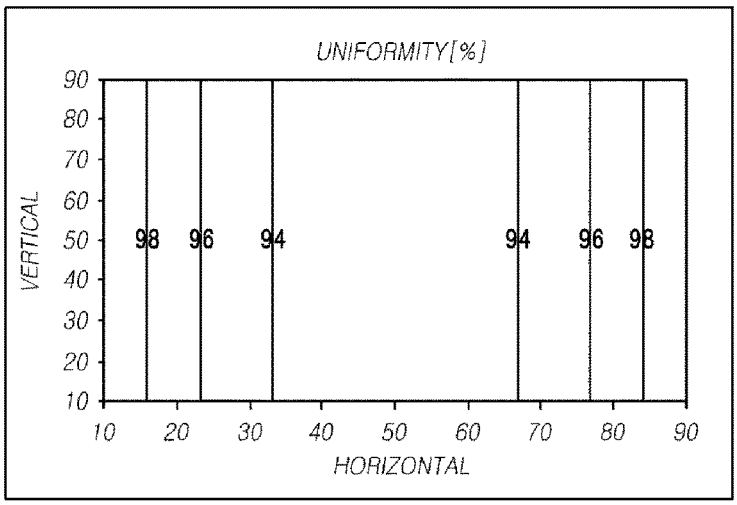

FIG. 15A and FIG. 15B illustrate the global uniformity of the pixel structure according to the second embodiment at a low gray level (63 Gray) and a high gray level (255 Gray).

Referring to FIG. 15A and FIG. 15B, it is appreciated that the pixel structure according to the second embodiment has superior global uniformity at either the low gray level (63 Gray) or the high gray level (255 Gray).

Figure 16:
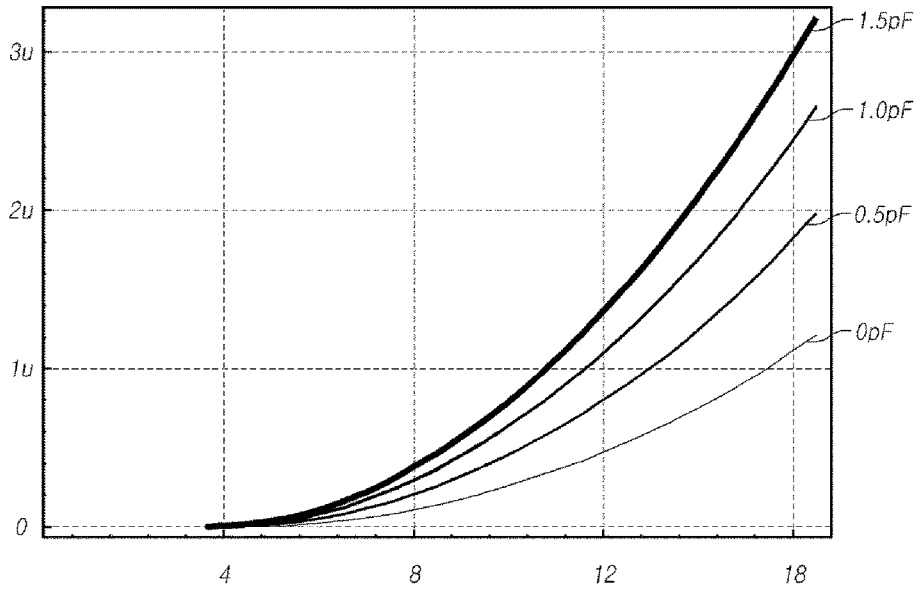

FIG. 16 illustrates variations in a current (Y axis) flowing through the OLED according to data voltages (X axis) in the pixel structure according to the second embodiment.

Referring to FIG. 16, steps 1.5, 1.0, 0.5 and 0 pF indicate the capacitances between a first electrode (e.g. an anode) of the OLED and the source voltage VSS.

Referring to FIG. 16, it is possible to design a capacitor to control current capacity when the current capacity is insufficient although the OLED operates like a capacitor. Specifically, even in the case that the data voltage is the same, it is possible to increase the amount of current flowing through the OLED by increasing the designed capacitance of the capacitor component of the OLED.

The 4T3C pixel structure according to the second embodiment and the operation of the pixel having the 4T3C pixel structure were described hereinabove.

Reference will now be made to a modified embodiment (third embodiment) of the 4T3C pixel structure according to the second embodiment and the operation thereof in conjunction with FIG. 17 and FIG. 18.

Figure 17:
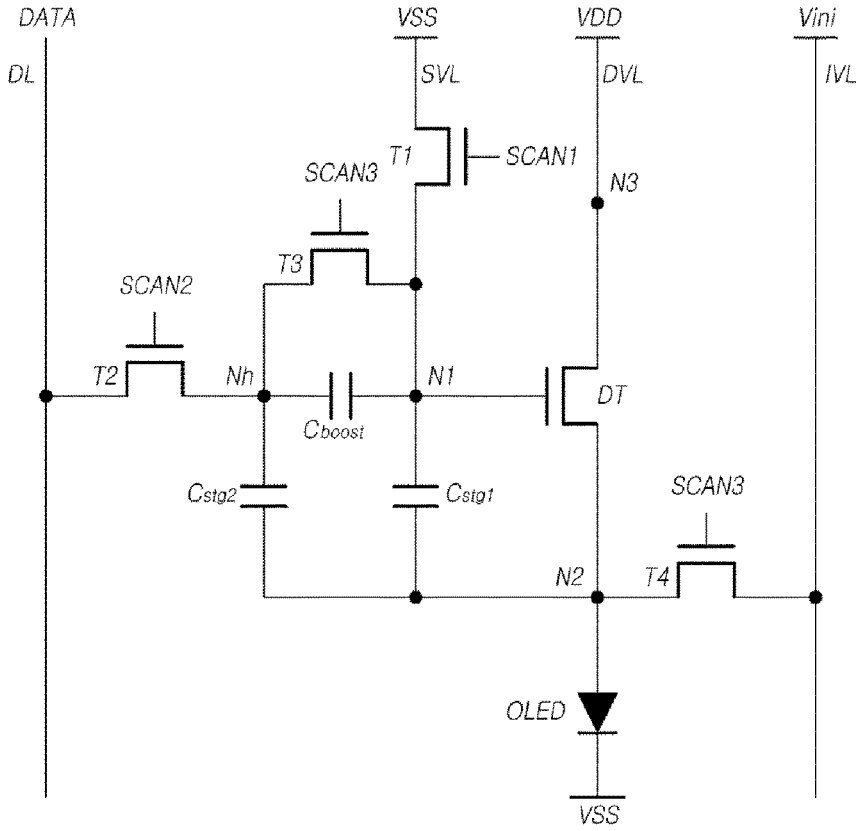
FIG. 17 is an equivalent circuit diagram illustrating a pixel structure of an organic light-emitting display device according to a third exemplary embodiment of the present invention.

FIG. 17 is an equivalent circuit diagram illustrating a pixel structure of an organic light-emitting display device 100 according to a third exemplary embodiment of the present invention.

Referring to FIG. 17, each of pixels of the organic light-emitting display device 100 according to the third embodiment has a pixel structure including: an organic light-emitting diode (OLED); five transistors including a driving transistor DT, a first transistor T1, a second transistor T2, a third transistor T3 and a fourth transistor T4; and three capacitors including a first storage capacitor Cstg1, a second storage capacitor Cstg2 and a boost capacitor Cboost.

The driving transistor DT includes a first node N1 forming a gate node, a second node N2 connected to the OLED and a third node N3 connected to a driving voltage line DVL through which a driving voltage VDD is supplied.

The first transistor T1 is controlled by a first scanning signal SCAN1, and is connected between a source voltage line SVL and the first node N1 of the driving transistor DT.

The first storage capacitor Cstg1 is connected between the first node N1 and the second node N2 of the driving transistor DT.

The second storage capacitor Cstg2 and the boost capacitor Cboost are connected between the first node N1 and the second node N2 of the driving transistor DT.

The second transistor T2 is controlled by a second scanning signal SCAN2, and is connected between a hold node Nh and a data line DL.

The third transistor T3 is controlled by a third scanning signal SCAN3, and is connected between the first node N1 of the driving transistor DT and the hold node Nh.

The fourth transistor T4 is connected between the second node N2 of the driving transistor DT and an initialization voltage line IVL through which an initialization voltage Vini is supplied.

The fourth transistor T4 is commonly controlled by the third scanning signal SCAN3 by which the third transistor T3 is controlled.

The 5T3C pixel structure according to the third embodiment illustrated in FIG. 17 is substantially identical to the 4T3C pixel structure according to the second embodiment illustrated in FIG. 5, except that the driving voltage VDD supplied through a driving voltage line DVL is a DC voltage, and that the fourth transistor T4 is added.

Accordingly, the second node N2 of the driving transistor DT is initialized by an initialization voltage IVL supplied through the initialization voltage line IVL in the pixel structure according to the third embodiment illustrated in FIG. 17, whereas the second node N2 of the driving transistor DT is initialized by VDD(−) in the 4T3C pixel structure according to the second embodiment illustrated in FIG. 5.

As described above, the operation system and operating characteristics of the 5T3C pixel structure according to the third embodiment illustrated in FIG. 17 are substantially identical to those of the 4T3C pixel structure according to the second embodiment illustrated in FIG. 5, except for the initialization of the second node N2 of the driving transistor DT.

Therefore, the operation timing of a pixel having the 5T3C pixel structure according to the third embodiment illustrated in FIG. 17 is identical to the operation timing of a pixel having the 4T3C pixel structure according to the second embodiment illustrated in FIG. 5.

The operation timing of the pixel having the 5T3C pixel structure according to the third embodiment illustrated in FIG. 17 will be described in brief with reference to FIG. 18.

Figure 18:
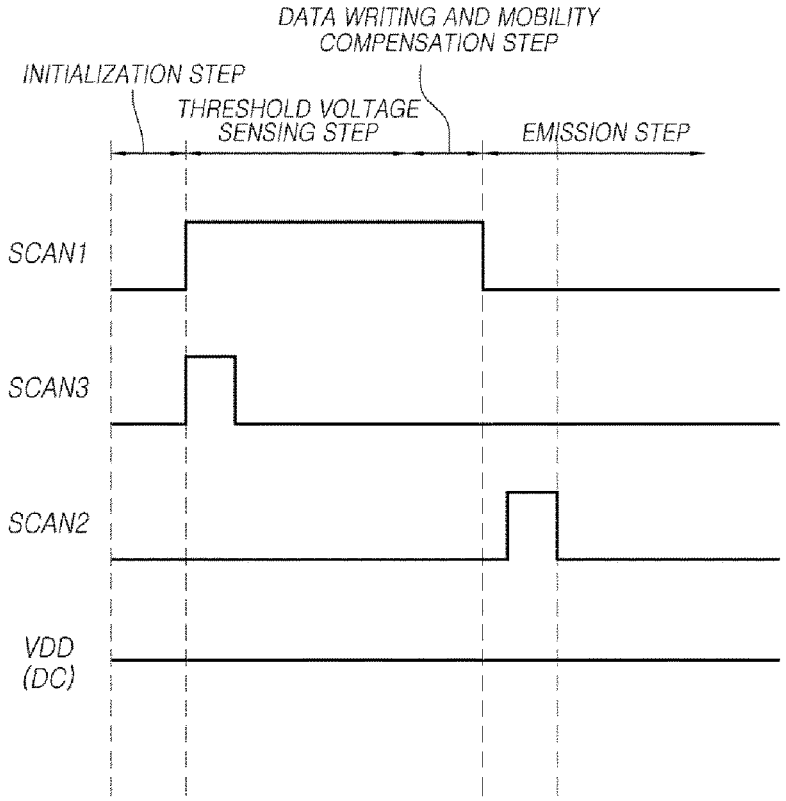
FIG. 18 is an operation timing diagram of a pixel having the pixel structure of the organic light-emitting display device according to the third exemplary embodiment.

Referring to FIG. 18, the pixel having the 5T3C pixel structure according to the third embodiment also carries out an operation, including an initialization step, a threshold voltage sensing step, a data writing and mobility compensation step and an emission step, as in the second embodiment.

Comparing the operation timing of a pixel having the 5T3C pixel structure according to the third embodiment illustrated in FIG. 17 with the operation timing of a pixel having the 4T3C pixel structure according to the second embodiment illustrated in FIG. 5, the operation system and operating characteristics thereof are identical except that the driving voltage VDD is a DC voltage in the 5T3C pixel structure.

Since the DC driving voltage VDD is supplied, the fourth transistor T4 is added to initialize the second node N2 of the driving transistor DT.

Therefore, at the initialization step, the DC driving voltage VDD is applied to the third node N3 of the driving transistor DT, the first transistor T1 is turned on by a high level first scanning signal SCAN1, the third transistor T3 and the fourth transistor T4 are turned on by a high level third scanning signal, and the second transistor T2 is turned on by a low level second scanning signal SCAN2.

Consequently, the hold node Nh and the first node N1 of the driving transistor DT are initialized by a source voltage VSS supplied through the first transistor T1, and the second node N2 of the driving transistor DT is initialized by the initialization voltage Vini supplied through the fourth transistor T4.

Descriptions of the threshold voltage sensing step, the data writing and mobility compensation step and the emission step will be omitted since they are identical to those of the operation of the 4T3C pixel structure according to the second embodiment.

The 4T3C pixel structure according to the second embodiment and the 5T3C pixel structure including one more transistor (the fourth transistor T4) according to the third embodiment were described hereinabove.

Reference will now be made to a 3T3C pixel structure according to a fourth embodiment corresponding to a modified embodiment of the 4T3C pixel structure according to the second embodiment in conjunction with FIG. 19 to FIG. 21.

Figure 19:
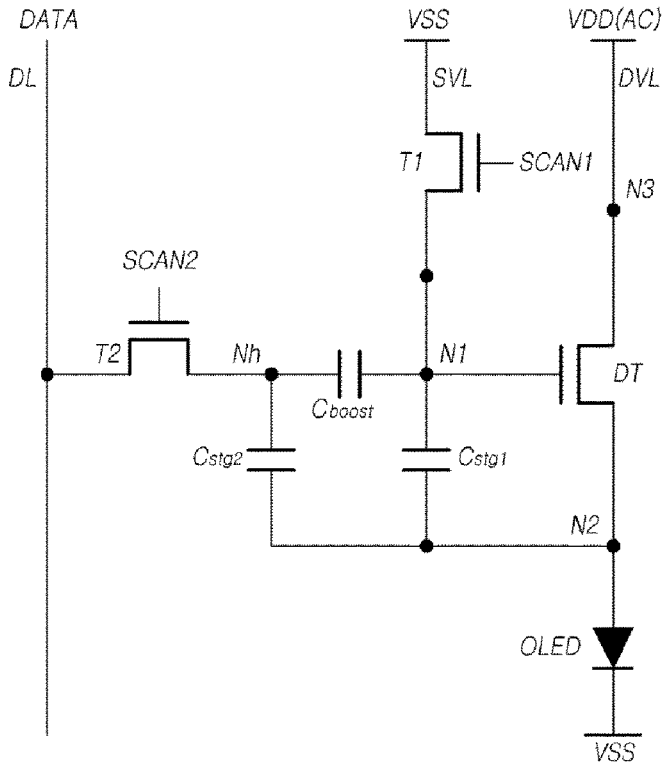
FIG. 19 is an equivalent circuit diagram illustrating a pixel structure of an organic light-emitting display device according to a fourth exemplary embodiment of the present invention.

FIG. 19 is an equivalent circuit diagram illustrating the pixel structure of an organic light-emitting display device 100 according to the fourth exemplary embodiment of the present invention.

The organic light-emitting display device 100 according to the fourth embodiment includes a display panel 110 on which a plurality of data lines DL1 to DLm and a plurality of gate lines GL1 to GLn are disposed such that a number of pixels P are defined, a data driver 120 for driving the data lines LD1 to DLm, a gate driver 130 for driving the gate lines GL1 to GLn, and a timing controller 140 for controlling the data driver 120 and the gate driver 130.

Referring to FIG. 19, each of a plurality of pixels of the organic light-emitting display device 100 according to the fourth embodiment has a 3T3C pixel structure including an organic light-emitting diode (OLED), a driving transistor DT, a first transistor T1, a second transistor T2, a first storage capacitor Cstg1, a second storage capacitor Cstg2 and a boost capacitor Cboost.

Here, the driving transistor DT serves to drive the OLED, and includes a first node N1 forming a gate node, a second node N2 connected to the OLED and a third node N3 connected to a driving voltage line DVL.

The first transistor T1 is controlled by a first scanning signal SCAN1, and is connected between a source voltage line SVL and the first node N1 of the driving transistor DT.

The first storage capacitor Cstg1 is connected between the first node N1 and the second node N2 of the driving transistor DT.

The second storage capacitor Cstg2 and the boost capacitor Cboost are connected between the first node N1 and the second node N2 of the driving transistor DT. The connecting node between the second storage capacitor and the boost capacitor forms a hold node Nh.

The second transistor T2 is controlled by a second scanning signal SCAN2, and is connected between the hold node Nh to which the second storage capacitor Cstg2 and the boost capacitor Cboost are connected and a data line DL.

Referring to FIG. 19, in each of the plurality of pixels of the organic light-emitting display device 100 according to the fourth embodiment, an AC driving voltage VDD is supplied to the third node N3 of the driving transistor DT through the driving voltage line DVL.

The operation of a pixel having the 3T3C pixel structure according to the fourth embodiment illustrated in FIG. 19 will be described with reference to FIG. 20 and FIG. 21.

Figure 20:
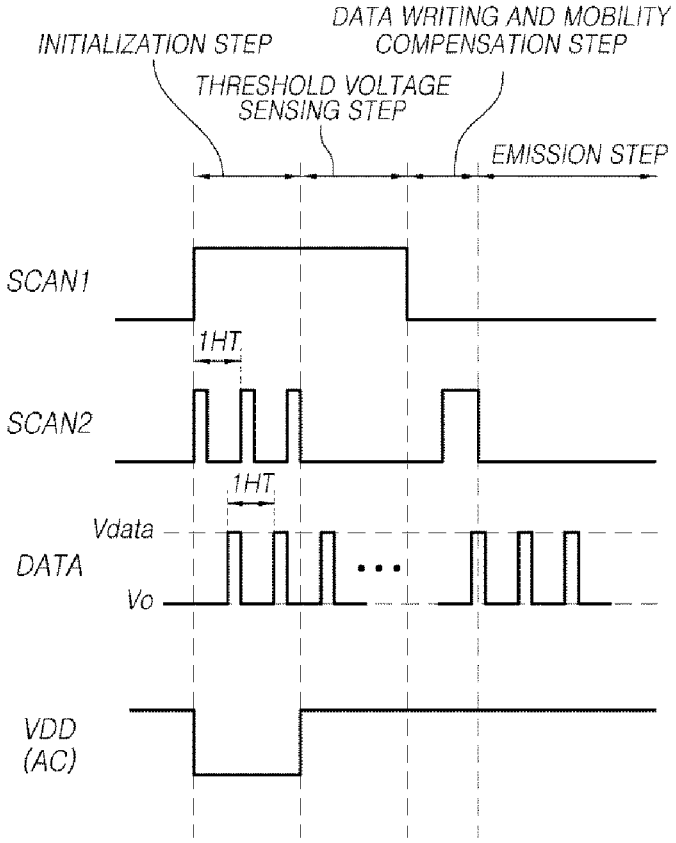
FIG. 20 and FIG. 21 are an operation timing diagram and a voltage change graph at major nodes in the pixel structure of the organic light-emitting display device according to the fourth exemplary embodiment.
Figure 21:
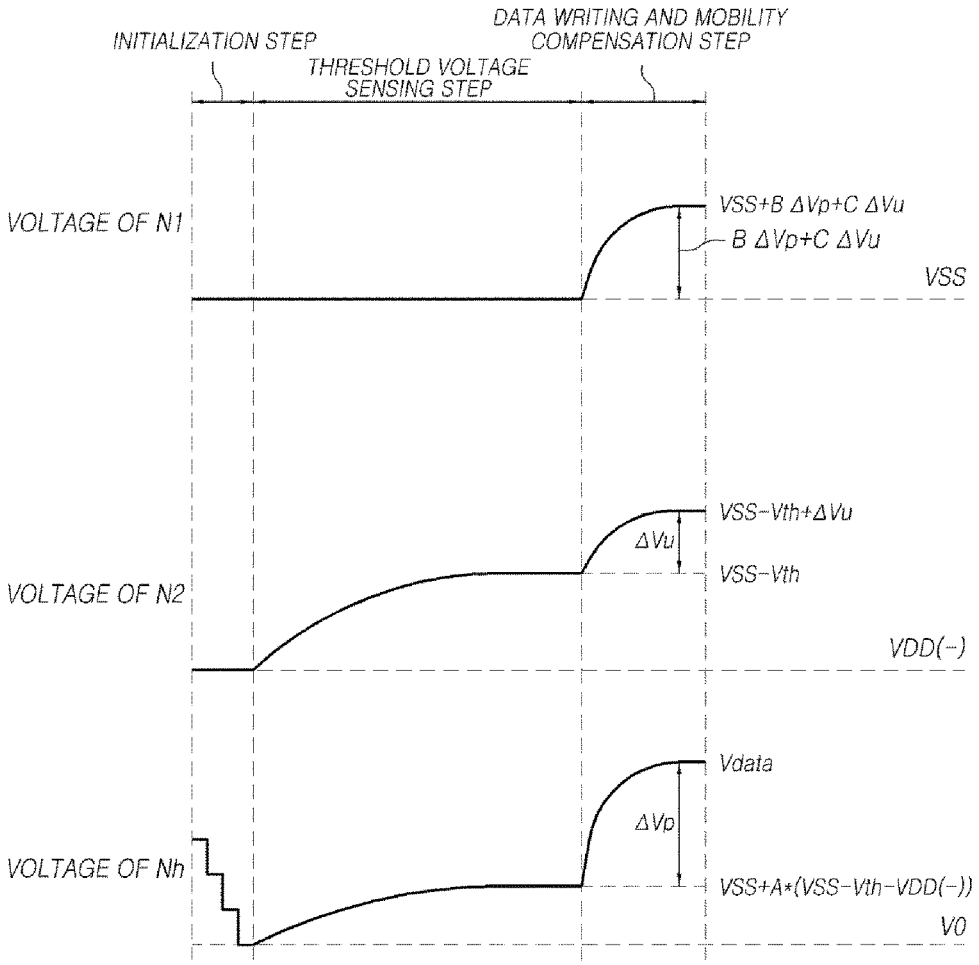

FIG. 20 and FIG. 21 are an operation timing diagram and a voltage change graph at major nodes in the pixel structure of the organic light-emitting display device 100 according to the fourth exemplary embodiment.

Referring to FIG. 20, the operation of a pixel having the 3T3C pixel structure according to the fourth embodiment is identical to the operation of a pixel having the 4T3C pixel structure according to the second embodiment.

In addition, referring to FIG. 20, the operation of the pixel having the 3T3C pixel structure according to the fourth embodiment includes an initialization step, a threshold voltage sensing step, a data writing and mobility compensation step and an emission step, like the operation of the pixel having the 4T3C pixel structure according to the second embodiment.

The operation of the pixel having the 3T3C pixel structure according to the fourth embodiment differs from the operation of the pixel having the 4T3C pixel structure according to the second embodiment in that the hold node Nh is initialized by a data voltage supplied through the data line DL, since the transistor (T3 in FIG. 5) for initializing the hold node Nh is not provided.

Therefore, input data voltages are divided into a low level initialization data voltage Vo and a high level data voltage Vdata, and the hold node Nh is initialized by the initialization data voltage Vo.

In the pixel having the 3T3C pixel structure according to the fourth embodiment, the hold node Nh is initialized by a voltage applied through the data line DL.

The voltage applied through the data line DL is a voltage in which the low level initialization data voltage Vo and the high level data voltage Vdata alternate with each other.

Accordingly, the transistor (T3 in FIG. 5) connected between the hold node Nh and the first node N1 of the driving transistor DT, as well as a scanning signal for controlling the transistor (T3 in FIG. 5), can be precluded.

In addition, referring to the operation timing of the initialization step in FIG. 20, since the hold node Nh is initialized by the low level initialization data voltage Vo, an initialization time may be insufficient when performing the initialization through the data line DL.

Therefore, it is possible to supplement the insufficient time by turning on the second scanning signal SCAN2 in a multiple fashion by a horizontal time (HT). Consequently, the second transistor T2 repeats turning on and off by the horizontal time (HT).

In this manner, at the initialization step, the hold node Nh is initialized to be in the shape of teeth by the low level initialization data voltage Vo, as illustrated in FIG. 21, according to the type of the data voltage Vdata+Vo and the type of the second scanning signal SCAN2.

Except for this initialization step, the other operation (at the threshold voltage sensing step, the data writing and mobility compensation step and the emission step) and the timing thereof are identical to those of the pixel having the 4T3C pixel structure according to the second embodiment.

Figure 11:
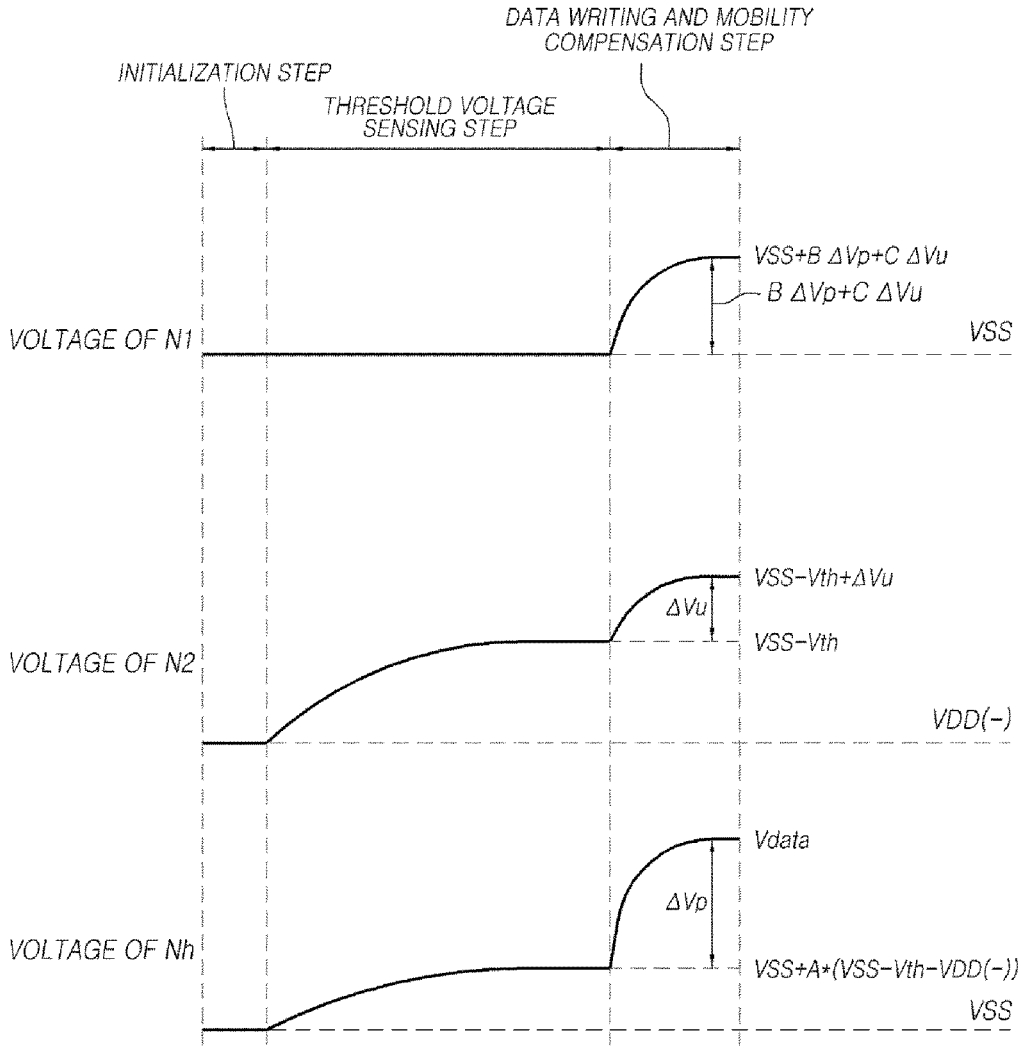

Accordingly, voltage changes at the first node N1, the second node N2 and the hold node Nh in the pixel having the 3T3C pixel structure according to the fourth embodiment illustrated in FIG. 21 are identical to voltage changes at the first node N1, the second node N2 and the hold node Nh in the pixel having the 4T3C pixel structure according to the second embodiment illustrated in FIG. 11, except for a voltage change at the hold node at the initialization step.

Descriptions of the other operation of the pixel having the 3T3C pixel structure according to the fourth embodiment at the threshold voltage sensing step, the data writing and mobility compensation step and the emission step and voltage changes at the nodes N1, N2 and Nh at these steps will be omitted since they are identical to those of the pixel having the 4T3C pixel structure according to the second embodiment.

Reference will now be made to a 4T3C pixel structure according to a fifth embodiment corresponding to a modified embodiment of the fourth embodiment and the operation of a pixel having the 3T3C pixel structure in conjunction with FIGS. 22 and 23.

Figure 22:
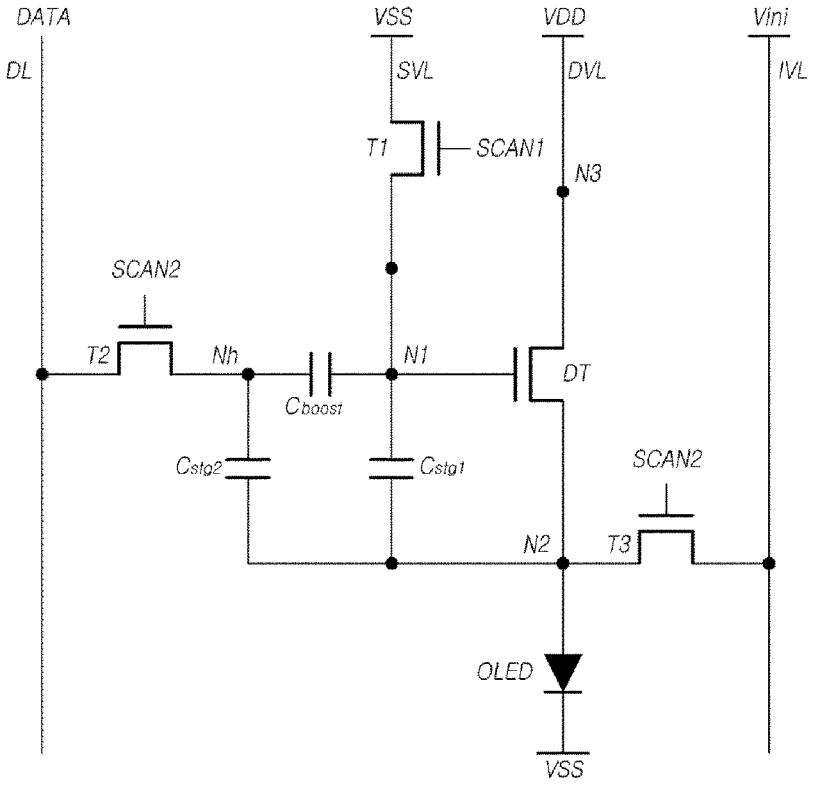
FIG. 22 is an equivalent circuit diagram illustrating a pixel structure of an organic light-emitting display device according to a fifth exemplary embodiment of the present invention.

FIG. 22 is an equivalent circuit diagram illustrating the pixel structure of an organic light-emitting display device 100 according to the fifth exemplary embodiment of the present invention.

Referring to FIG. 22, the pixel structure of each of a plurality of pixels of the organic light-emitting display device 100 according to the fifth embodiment is substantially identical to the 3T3C pixel structure according to the fourth embodiment illustrated in FIG. 19, except that a DC driving voltage VDD is applied to a third node N3 of a driving transistor DT and, for this, a third transistor T3 connected between a second node N2 of a driving transistor DT and an initialization voltage line IVL is added.

Specifically, the driving transistor DT drives an organic light-emitting diode (OLED), and includes a first node N1 forming a gate node, a second node N2 connected to the OLED and the third node N3 connected to the driving voltage line DVL. The first transistor T1 is controlled by a first scanning signal SCAN1, and is connected between a source voltage line SVL and the first node N1 of the driving transistor DT. The first storage capacitor Cstg1 is connected between the first node N1 and the second node N2 of the driving transistor DT. The second storage capacitor Cstg2 and the boost capacitor Cboost are connected between the first node N1 and the second node N2 of the driving transistor DT. The connecting node between the second storage capacitor and the boost capacitor forms a hold node Nh. The second transistor T2 is controlled by a second scanning signal SCAN2, and is connected between the hold node Nh to which the second storage capacitor Cstg2 and the boost capacitor Cboost are connected and a data line DL.

The pixel structure of each of the plurality of pixels of the organic light-emitting display device 100 according to the fifth embodiment illustrated in FIG. 22 forms a 5T3C pixel structure, since this pixel structure has one more transistor (i.e. the third transistor T3) than the 4T3C pixel structure according to the fourth embodiment illustrated in FIG. 19.

The third transistor T3 added to the 5T3C pixel structure according to the fifth embodiment is commonly controlled by the second scanning signal SCAN2 by which the second transistor T2 is controlled.

Figure 23:
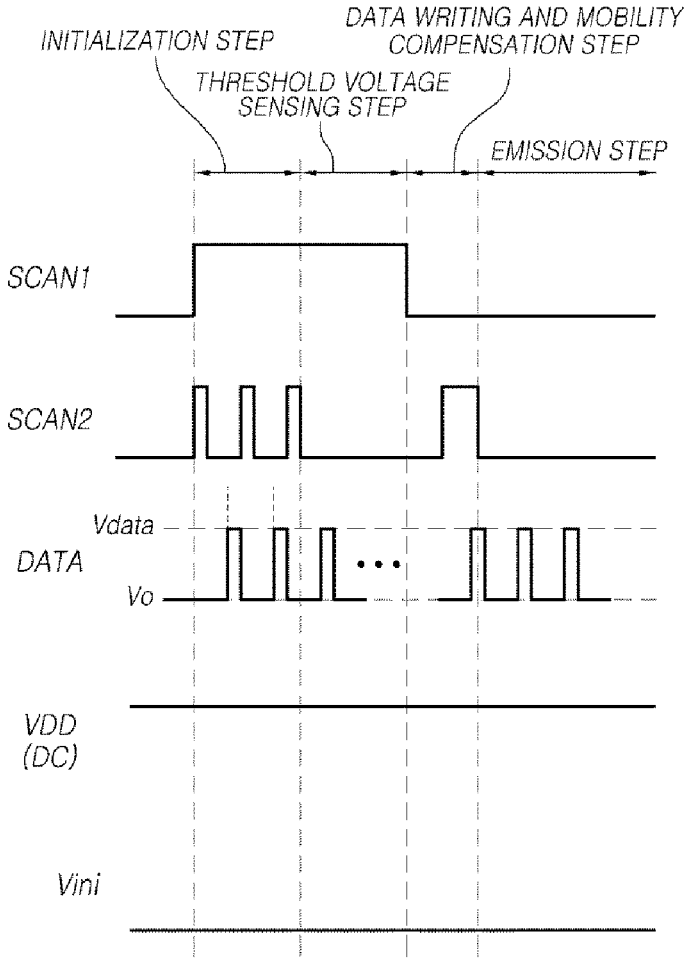
FIG. 23 is an operation diagram of a pixel having the pixel structure of the organic light-emitting display device according to the fifth exemplary embodiment.

With reference to FIG. 23, a description will be given below of the operation of a pixel having the 5T3C pixel structure according to the fifth embodiment illustrated in FIG. 22.

Referring to FIG. 23, the operation timing of the pixel having the 5T3C pixel structure according to the fifth embodiment is substantially identical to the operation timing of the pixel having the 4T3C pixel structure according to the fourth embodiment illustrated in FIG. 20, except that a DC driving voltage VDD is supplied and, consequently, an initialization voltage Vini is applied to the second node N2 of the driving transistor DT through the third transistor T3 connected to the second node N2 of the driving transistor DT.

According to the present invention as set forth above, the organic light-emitting display device has the pixel structure able to significantly improve threshold voltage compensation capability and range by compensating for a loss in a threshold voltage that would occur during operation.

That is, the use of the pixel structure according to the certain embodiments of the present invention makes it possible to store a relative threshold voltage in addition to an absolute threshold voltage, thereby compensating for a loss in the threshold voltage.

The organic light-emitting display device has the pixel structure able to compensate for mobility and control a mobility compensation time based on a capacitor design within the pixel structure, thereby achieving a sufficient data writing time.

That is, the use of the pixel structure according to the certain embodiments of the invention makes it possible to control a mobility sensing time to a desirable time using an internal capacitor, thereby achieving a sufficient data writing time.

The organic light-emitting display device has the pixel structure having superior global uniformity characteristics.

The foregoing descriptions and the accompanying drawings have been presented in order to explain the certain principles of the present invention. A person skilled in the art to which the invention relates can make many modifications and variations by combining, dividing, substituting for or changing elements without departing from the principle of the invention. The foregoing embodiments disclosed herein shall be interpreted as illustrative only not as limitative of the principle and scope of the invention. It should be understood that the scope of the invention shall be defined by the appended Claims and all of their equivalents fall within the scope of the invention.

What is claimed is:

1. An organic light-emitting display device comprising:
- a display panel on which data lines and gate lines are arranged to define a number of pixels;
- a data driver driving the data lines;
- a gate driver driving the gate lines; and
- a timing controller controlling the data driver and the gate driver, wherein each of the pixels comprises:
- an organic light-emitting diode;
  - a driving transistor driving the organic light-emitting diode, wherein the driving transistor includes a first node forming a gate node, a second node connected to the organic light-emitting diode and a third node connected to a driving voltage line;
  - a first transistor controlled by a first scanning signal, the first transistor being connected between a source voltage line and the first node of the driving transistor;
  - a first storage capacitor connected between the first node and the second node of the driving transistor;

a second storage capacitor and a boost capacitor between the first node and the second node of the driving transistor;

a second transistor controlled by a second scanning signal, the second transistor being connected between a hold node to which the second storage capacitor and the boost capacitor are connected and a corresponding data line of the data lines; and a third transistor controlled by a third scanning signal, the third transistor being connected between the first node of the driving transistor and the hold node, wherein the first transistor is turned on and then turned off, the third transistor is turned on and off during the on-state period of the first transistor and maintains the off-state during off-state period of the first transistor, and the second transistor remains the off-state during the on-state period of the first transistor and is turned on during the off-state period of the first transistor.

2. The organic light-emitting display device according to claim 1, wherein a capacitance of the second storage capacitor is smaller than a capacitance of the first storage capacitor or a capacitance of the boost capacitor.

3. The organic light-emitting display device according to claim 1, wherein a driving voltage supplied through the driving voltage line is an alternating current voltage, and each of the number of pixels performs an initialization operation, a threshold voltage sensing operation, a data writing and mobility compensation operation and an emission operation.

4. The organic light-emitting display device according to claim 3, wherein, at the initialization operation, a low level driving voltage is applied to the third node of the driving transistor, the first and third transistors are turned on, and the second transistor is turned off, such that the hold node and the first node of the driving transistor are initialized by a source voltage, and the second node of the driving transistor is initialized by the low level driving voltage.

5. The organic light-emitting display device according to claim 4, wherein, at the threshold voltage sensing operation, a high level driving voltage is applied to the third node of the driving transistor, the first transistor is maintained in a turned-on state, the second transistor is turned off, and the third transistor is maintained in a turned-off state, such that the first node of the driving transistor is maintained at the source voltage, a voltage at the second node of the driving transistor increases, and a voltage at the hold node increases according to a voltage change at the second node of the driving voltage and a first capacitance ratio.

6. The organic light-emitting display device according to claim 5, wherein the voltage at the hold node increases to a voltage obtained by multiplying the voltage change at the second node of the driving voltage with the first capacitance ratio, and the first capacitance ratio is a value obtained by dividing the capacitance of the second storage capacitor with a total of the capacitance of the boost capacitor and the capacitance of the second storage capacitor.

7. The organic light-emitting display device according to claim 5, wherein, at the data writing and mobility sensing operation, a data voltage is applied to the second transistor through the corresponding data line, a high level driving voltage is applied to the third node of the driving transistor, the first transistor is turned off, and the second transistor is turned on, such that a voltage at the hold node increases, a voltage at the second node of the driving transistor increases according to the mobility sensing operation, and a voltage at the first node of the driving transistor increases according to a voltage change at the hold node, a voltage change at the second node of the driving transistor, a second capacitance ratio and a third capacitance ratio.

8. The organic light-emitting display device according to claim 7, wherein the voltage at the first node of the driving transistor increases by a total of a voltage obtained by multiplying the voltage change at the hold node with the second capacitance ratio and a voltage obtained by multiplying the voltage change at the second node of the driving transistor with the third capacitance ratio.

9. The organic light-emitting display device according to claim 8, wherein the second capacitance ratio is a value obtained by dividing the capacitance of the boost capacitor with a total of the capacitance of the first storage capacitor and the capacitance of the boost capacitor, and the third capacitance ratio is a value obtained by dividing the capacitance of the first storage capacitor with the total of the capacitance of the first storage capacitor and the capacitance of the boost capacitor.

10. The organic light-emitting display device according to claim 7, wherein the third capacitance ratio determines a rate at which a voltage difference between the first node and the second node of the driving transistor decreases.

11. The organic light-emitting display device according to claim 7, wherein, at the emission operation, the driving transistor, the first transistor, the second transistor and the third transistor are turned off, and the organic light-emitting diode emits light while the voltage at the second node of the driving transistor increases.

12. The organic light-emitting display device according to claim 11, wherein the capacitance of the second storage capacitor determines an amount to control at compensation for a loss in threshold voltage information caused by a parasitic capacitor of the first node of the driving transistor.

13. The organic light-emitting display device according to claim 1, wherein a driving voltage supplied through the driving voltage line is a direct current voltage, and each of the number of pixels performs an initialization operation, a threshold voltage sensing operation, a data writing and mobility compensation operation and an emission operation, each of the number of pixels further comprising a fourth transistor connected between the second node of the driving transistor and an initialization voltage line, the fourth transistor being controlled by the third scanning signal by which the third transistor is controlled.

14. The organic light-emitting display device according to claim 13, wherein, at the initialization operation, the driving voltage is applied to the third node of the driving transistor, and the first transistor, the third transistor and the fourth transistor are turned on, and the second transistor is turned off, such that the hold node and the first node of the driving transistor are initialized by a source voltage, and the second node of the driving transistor is initialized by an initialization voltage.

* * * * *